US011332292B2

(12) United States Patent
Otsuka et al.

(10) Patent No.: US 11,332,292 B2
(45) Date of Patent: May 17, 2022

(54) CONTAINER

(71) Applicant: Kao Corporation, Tokyo (JP)

(72) Inventors: Takahiro Otsuka, Sumida-ku (JP); Yoshinori Inagawa, Sumida-ku (JP); Mitsugu Iwatsubo, Sumida-ku (JP); Daisuke Kodama, Sumida-ku (JP)

(73) Assignee: Kao Corporation, Tokyo (JP)

( * ) Notice: Subject to any disclaimer, the term of this patent is extended or adjusted under 35 U.S.C. 154(b) by 152 days.

(21) Appl. No.: 16/324,407

(22) PCT Filed: Mar. 7, 2017

(86) PCT No.: PCT/JP2017/008929
§ 371 (c)(1),
(2) Date: Feb. 8, 2019

(87) PCT Pub. No.: WO2018/163269
PCT Pub. Date: Sep. 13, 2018

(65) Prior Publication Data

US 2019/0168941 A1 Jun. 6, 2019

(51) Int. Cl.
*B65D 77/06* (2006.01)
*B65D 75/58* (2006.01)
(Continued)

(52) U.S. Cl.
CPC ..... *B65D 77/06* (2013.01); *B65D 1/0246* (2013.01); *B65D 1/0276* (2013.01); *B65D 65/40* (2013.01);
(Continued)

(58) Field of Classification Search
CPC .. B65D 77/06; B65D 75/5883; B65D 75/008; B65D 65/40; B65D 2501/0081; B65D 33/02
See application file for complete search history.

(56) References Cited

U.S. PATENT DOCUMENTS 5,344,045 A * 9/1994 Richter ..... B65D 1/0215 215/12.2
10,005,261 B2 6/2018 Stanley et al.
(Continued)

FOREIGN PATENT DOCUMENTS

CN 1633381 A 6/2005
CN 102947196 A 2/2013
(Continued)

OTHER PUBLICATIONS

International Search Report dated Jun. 13, 2017, in PCT/JP2017/008929 filed on Mar. 7, 2017.
(Continued)

*Primary Examiner* — Don M Anderson
(74) *Attorney, Agent, or Firm* — Oblon, McClelland, Maier & Neustadt, L.L.P.

(57) ABSTRACT

A container has an inner container that accommodates an article, with an opening through which the article can be discharged; and a cover that is composed of a cover-forming sheet member given by lamination of a plurality of film layers, and covers the inner container; the cover-forming sheet member has a film region in which the plurality of film layers are attached to each other, and filler enclosing parts in which a filler is enclosed between the plurality of film layers, and bulges in the thickness direction of the cover-forming sheet member than the film region; and, the inner container has an outer air introducing part through which the outer air is introduced between the outer surface of the inner container and the inner surface of the cover.

18 Claims, 31 Drawing Sheets

(51) Int. Cl.
*B65D 1/02* (2006.01)
*B65D 65/40* (2006.01)
*B65D 75/52* (2006.01)

(52) U.S. Cl.
CPC ..... *B65D 75/52* (2013.01); *B65D 75/5883* (2013.01); *B65D 2501/0081* (2013.01)

(56) References Cited

U.S. PATENT DOCUMENTS

| | | | | |
|---|---|---|---|---|
| 10,850,892 | B2 * | 12/2020 | Kodama ..... | B65D 33/004 |
| 2013/0292287 | A1 | 11/2013 | Stanley et al. | |
| 2013/0292353 | A1 | 11/2013 | Stanley et al. | |
| 2016/0176583 | A1 * | 6/2016 | Ishihara ..... | B65D 33/02 53/452 |

FOREIGN PATENT DOCUMENTS

| | | | |
|---|---|---|---|
| CN | 103261051 | A | 8/2013 |
| CN | 203345437 | U | 12/2013 |
| CN | 105228944 | A | 1/2016 |
| EP | 2 671 818 | A1 | 12/2013 |
| EP | 3 348 488 | A1 | 7/2018 |
| JP | 3-126875 | U | 12/1991 |
| JP | 9-504253 | A | 4/1997 |
| JP | 2535548 | Y2 | 5/1997 |
| JP | 10-287365 | A | 10/1998 |
| JP | 2000-109095 | A | 4/2000 |
| JP | 2008-29672 | A | 2/2008 |
| JP | 2012-250732 | A | 12/2012 |
| JP | 2014-5030 | A | 1/2014 |
| JP | 2014-144803 | A | 8/2014 |
| JP | 2015-6891 | A | 1/2015 |
| JP | 2015-520707 | A | 7/2015 |
| JP | 2017-141063 | A | 8/2017 |
| JP | 2018-108842 | A | 7/2018 |
| JP | 2018-108843 | A | 7/2018 |
| JP | 2018-144363 | A | 9/2018 |
| JP | 2018-144856 | A | 9/2018 |
| JP | 2018-144857 | A | 9/2018 |
| JP | 2018-144860 | A | 9/2018 |
| JP | 2018-144885 | A | 9/2018 |
| JP | 2018-144886 | A | 9/2018 |
| TW | 201412526 | A | 4/2014 |
| WO | WO 2013/124201 | A1 | 8/2013 |
| WO | WO 2013/169681 | A1 | 11/2013 |

OTHER PUBLICATIONS

Office Action dated Jan. 19, 2021 in corresponding European Patent Application No. 17 899 991.8, 6 pages.

Combined Chinese Office Action and Search Report dated Mar. 24, 2021 in Chinese Patent Application No. 201780050080.3 (with English translation), 26 pages.

Extended European Search Report dated Mar. 10, 2020 in corresponding European Patent Application No. 17899991.8, 7 pages.

Decision to Grant dated Nov. 4, 2020 in Japanese Patent Application No. 2017-154668 (with English translation), 5 pages.

* cited by examiner

300

300

CONTAINER

CROSS REFERENCE TO RELATED APPLICATION

This application is a national phase application of PCT/JP2017/008929, filed Mar. 7, 2017, the entire content and disclosure of which is incorporated into the present application.

TECHNICAL FIELD

This invention relates to a container, a packed article in container, a sheet for container, a container forming sheet, and a method for manufacturing a container.

BACKGROUND ART

As a soft packaging container composed of a sheet member, in recent years, there has been proposed a type of container having a non-attached part partially formed between layers composing the sheet member, with air or other filler enclosed in such non-attached part to form a filler enclosing part, for the purpose of improving shape retention property and the like (e.g., Patent Document 1).

RELATED ART DOCUMENT

Patent Document 1 WO2013/169681, pamphlet

SUMMARY OF THE INVENTION

This invention relates to a container which includes:

an inner container that accommodates an article, with an opening through which the article can be discharged; and a cover that is composed of a cover-forming sheet member given by lamination of a plurality of film layers, and covers the inner container, the cover-forming sheet member has a film region in which the plurality of film layers are attached to each other, and a filler enclosing part in which a filler is enclosed between the plurality of film layers, and bulges in the thickness direction of the cover-forming sheet member than the film region, and, the container including an outer air introducing part through which the outer air is introduced between the outer surface of the inner container and the inner surface of the cover.

Figure 15:
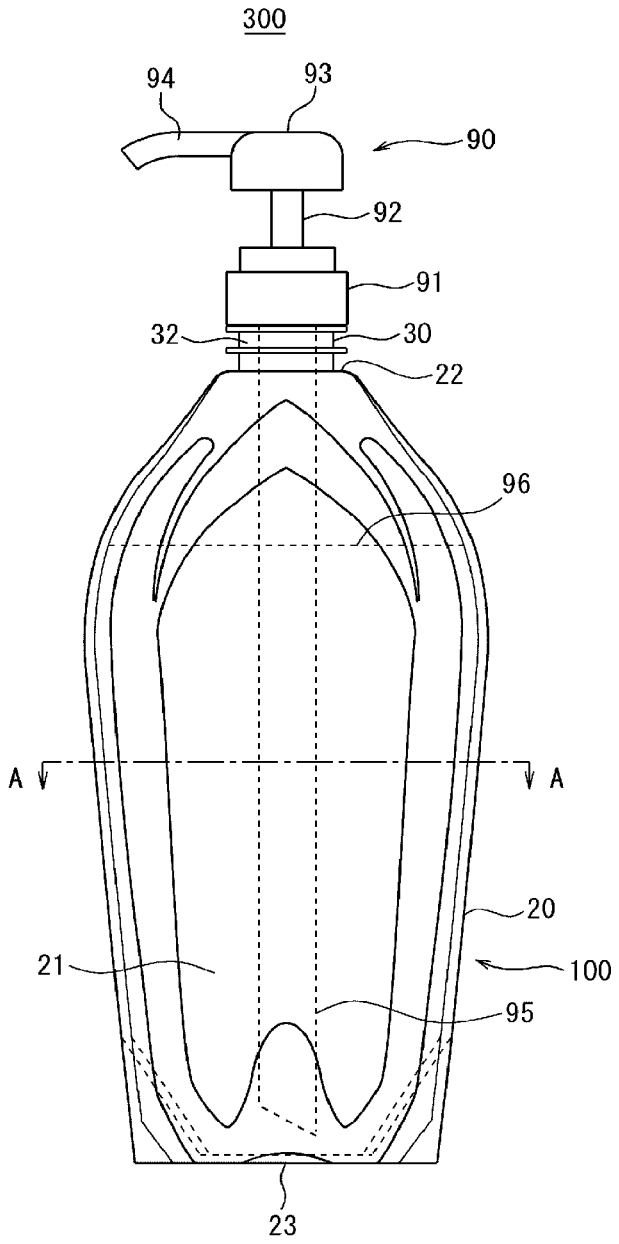
FIG. 15 is a front elevation illustrating a packed article in container of the first embodiment, with a pumping cap attached thereto.
Figure 16A:
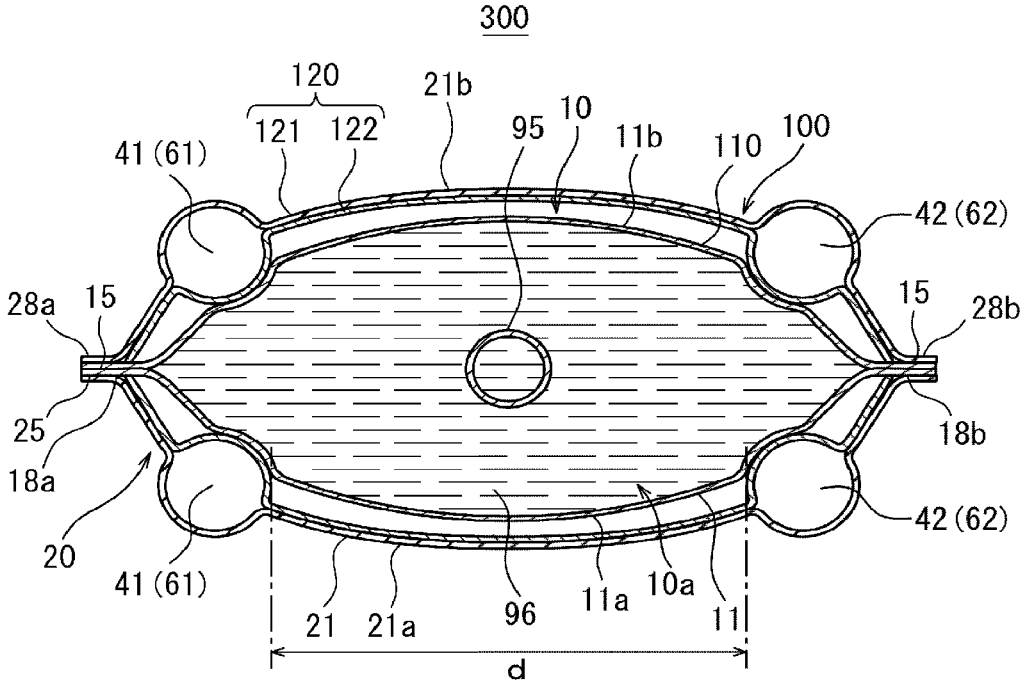
Figure 16B:
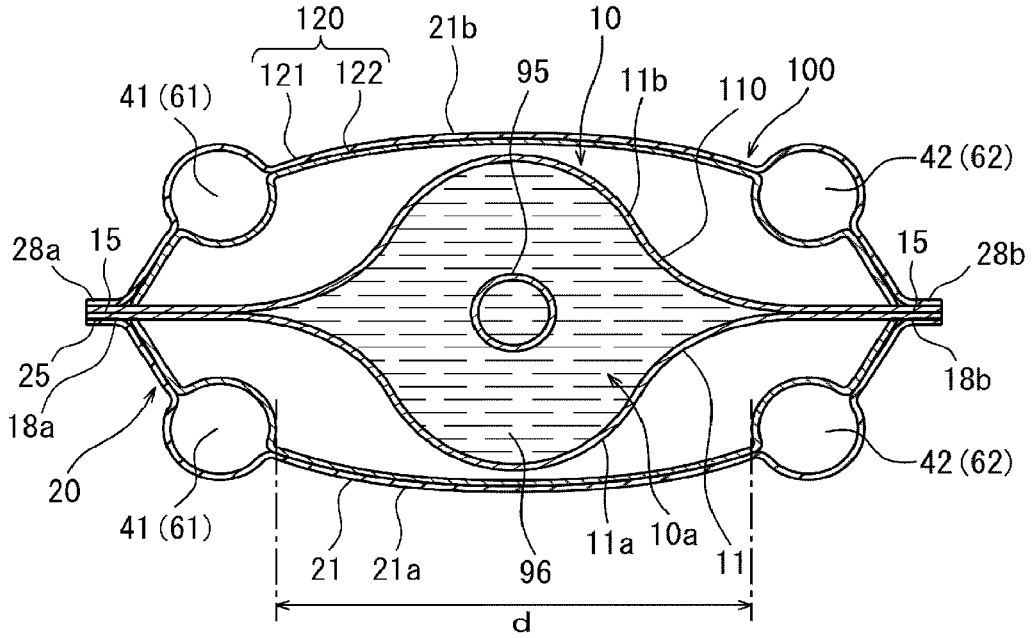

Each of FIG. 16(*a*) and FIG. 16(*b*) is a cross sectional view taken along line A-A in FIG. 15, wherein FIG. 16(*b*) illustrates a less volume of article remaining in the accommodating area, as compared with the volume illustrated in FIG. 16(*a*).

Figure 9B:
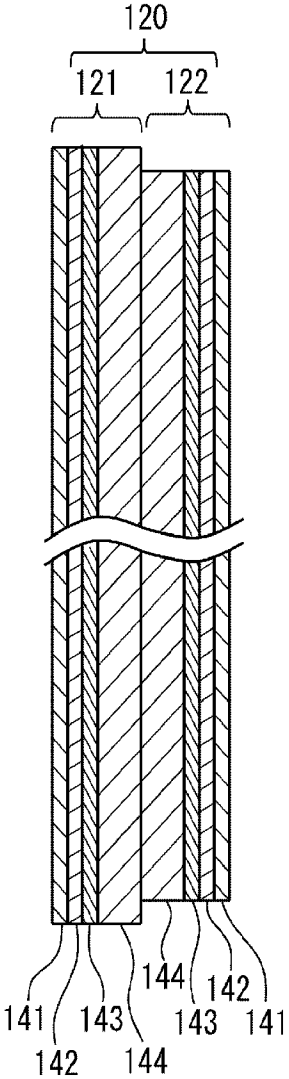
FIG. 9(*a*) is a plan view illustrating the cover-forming sheet member that composes the cover of the container of the first embodiment, and FIG. 9(*b*) is a cross sectional view illustrating the cover-forming sheet member that composes the cover of the container of the first embodiment.
Figure 9A:
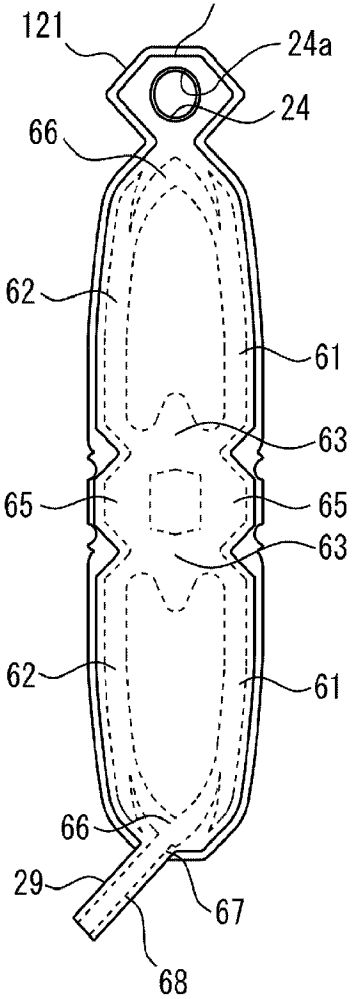
Figure 17:
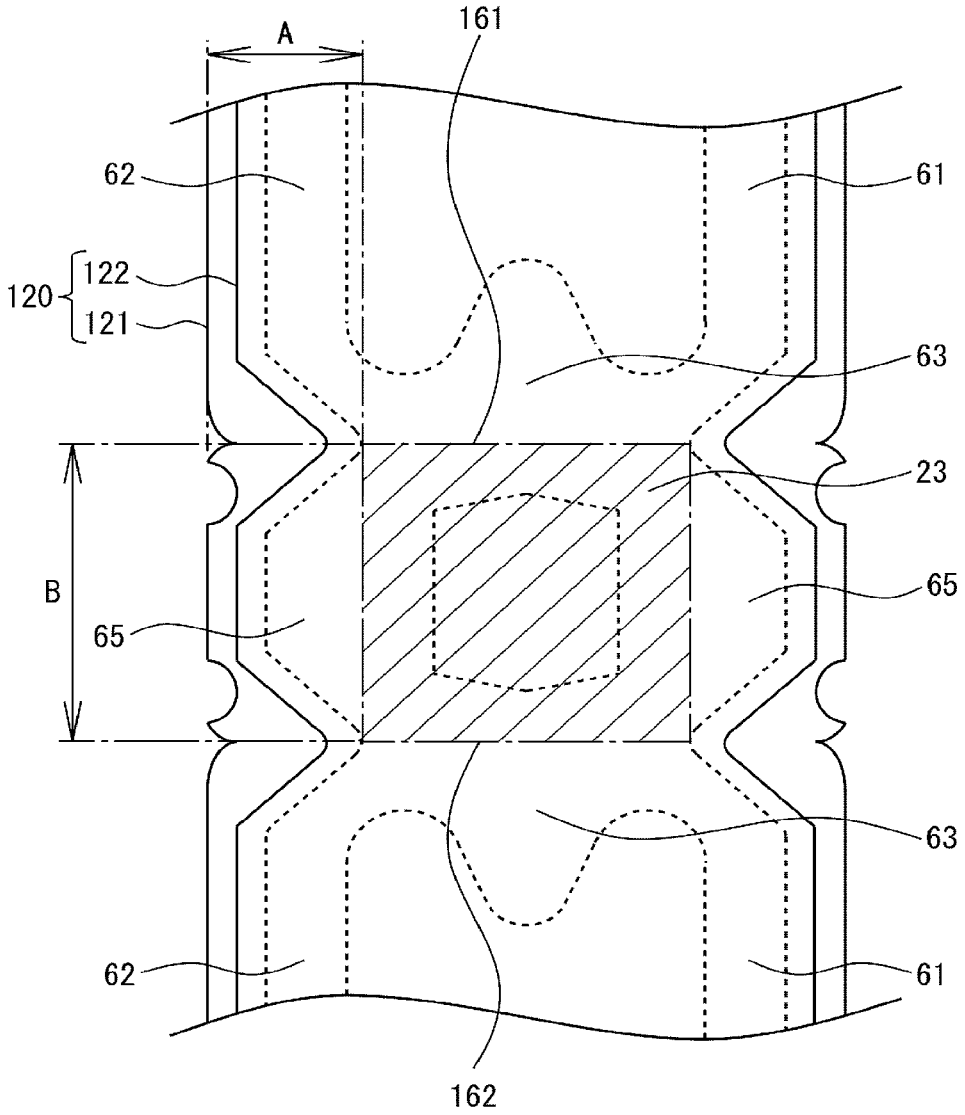

FIG. 17 is a partial enlarged view of FIG. 9(*a*).

Figure 3:
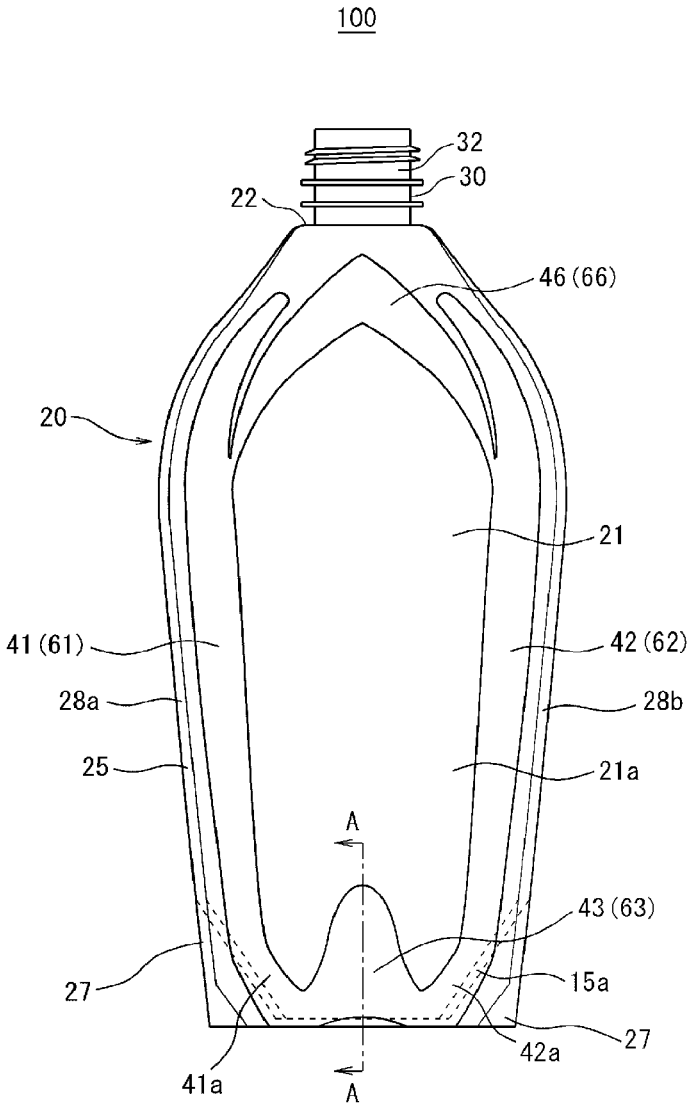
FIG. 3 is a front elevation illustrating the container of the first embodiment.
Figure 18:
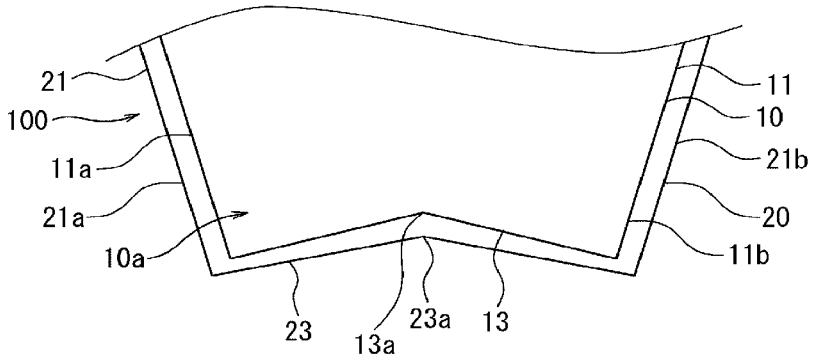

FIG. 18 is a schematic side cross sectional view taken along line A-A in FIG. 3.

Figure 19:
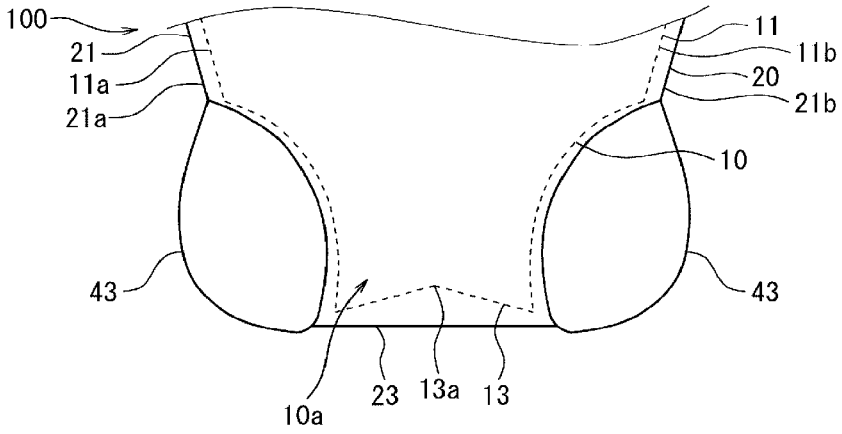

FIG. 19 is a schematic side elevation illustrating a lower end of the container of the first embodiment.

Figure 20:
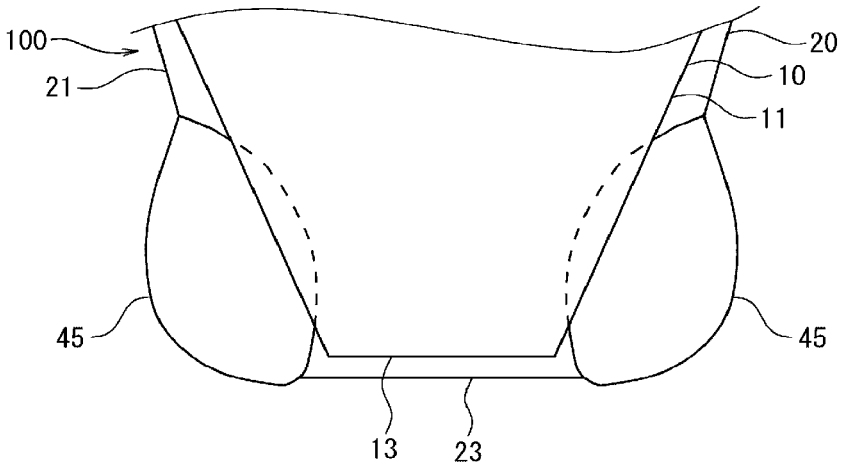

FIG. 20 is a schematic front elevation illustrating the lower end of the container of the first embodiment.

Figure 21:
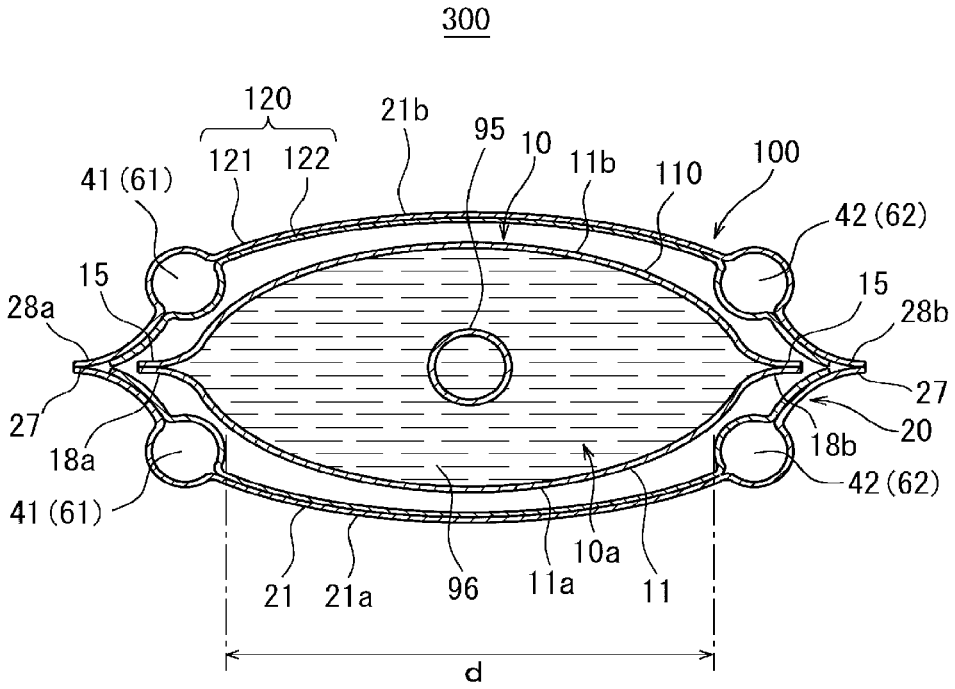

FIG. 21 is a plane cross sectional view illustrating a packed article in container according to Modified Example 1 of the first embodiment.

Figure 22A:
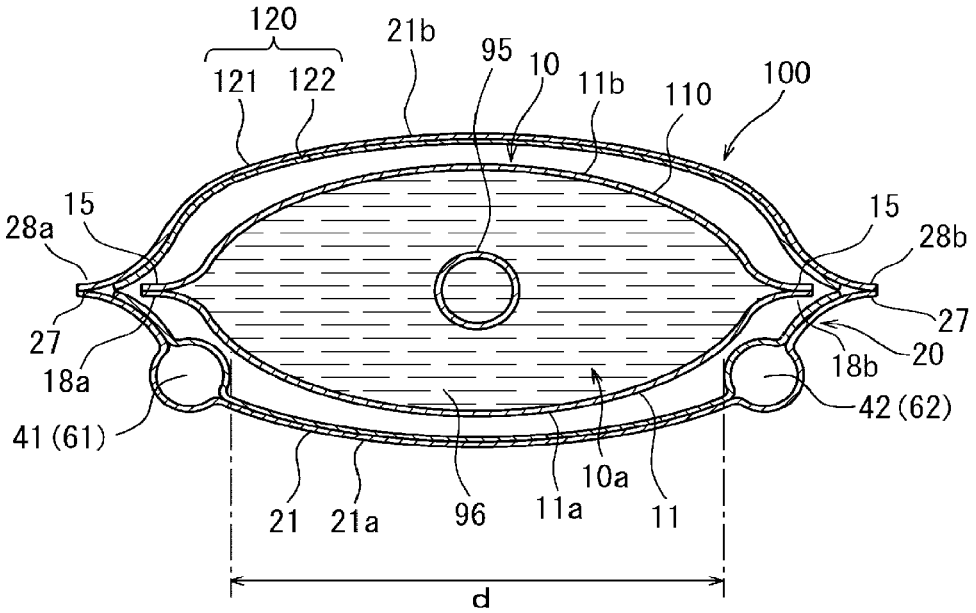
Figure 22B:
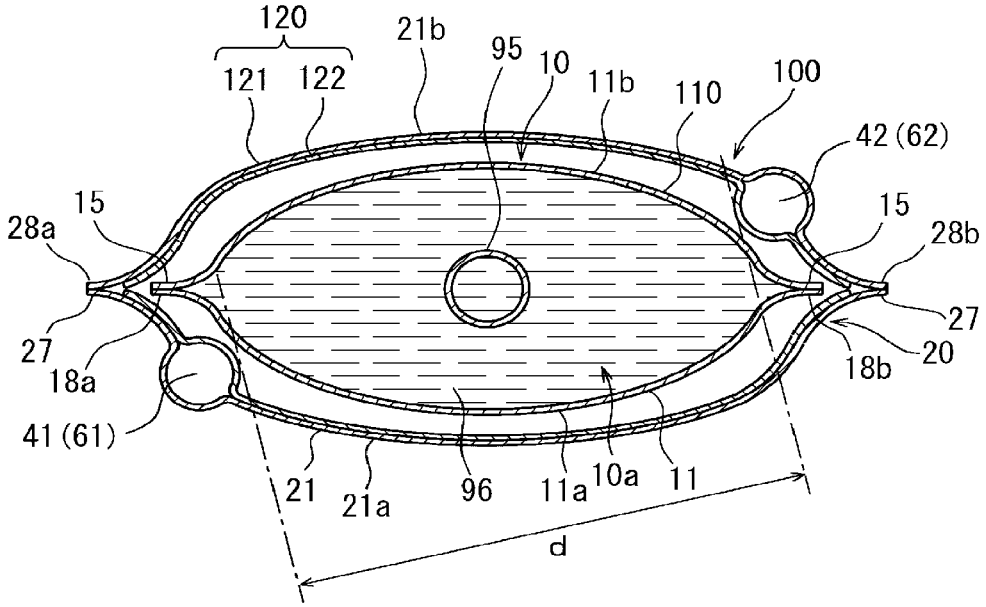

FIG. 22(*a*) is a plane cross sectional view illustrating a packed article in container according to Modified Example 2 of the first embodiment, and FIG. 22(*b*) is a plane cross sectional view illustrating a packed article in container according to Modified Example 3 of the first embodiment.

Figure 23A:
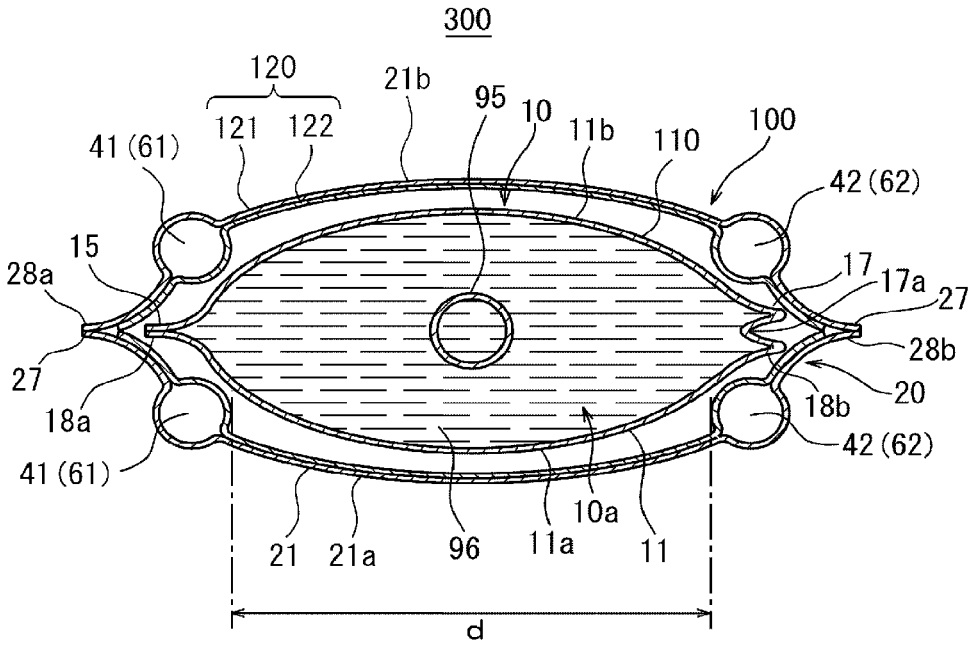
Figure 23B:
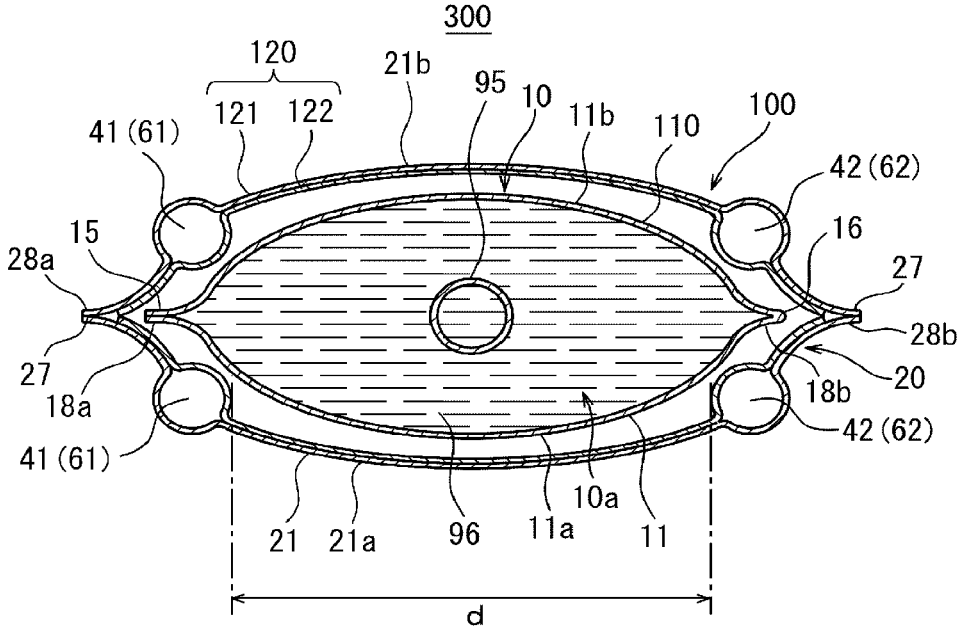

FIG. 23(*a*) is a plane cross sectional view illustrating a packed article in container according to Modified Example 4 of the first embodiment, and FIG. 23(*b*) is a plane cross sectional view illustrating a packed article in container according to Modified Example 5 of the first embodiment.

Figure 24:
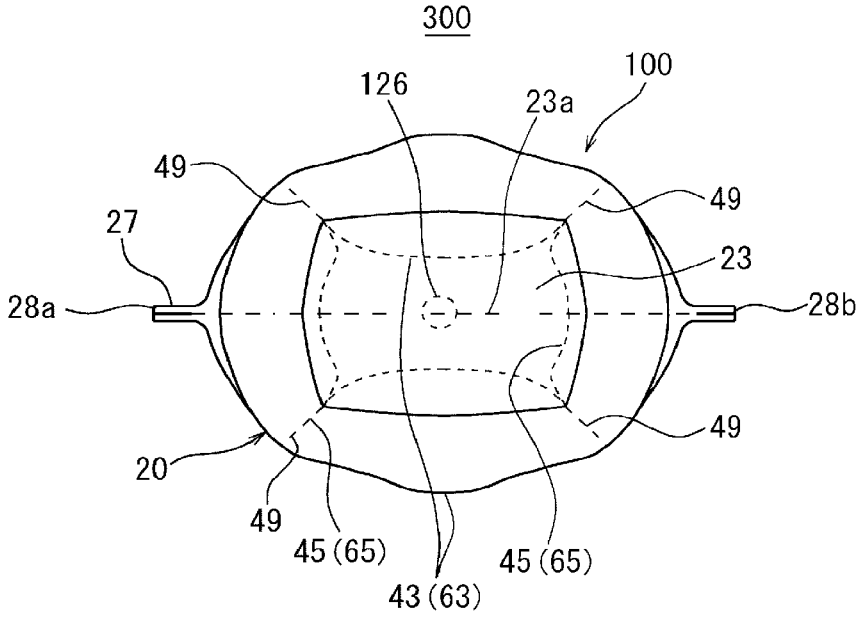

FIG. 24 is a bottom view illustrating a packed article in container according to Modified Example 6 of the first embodiment.

Figure 25:
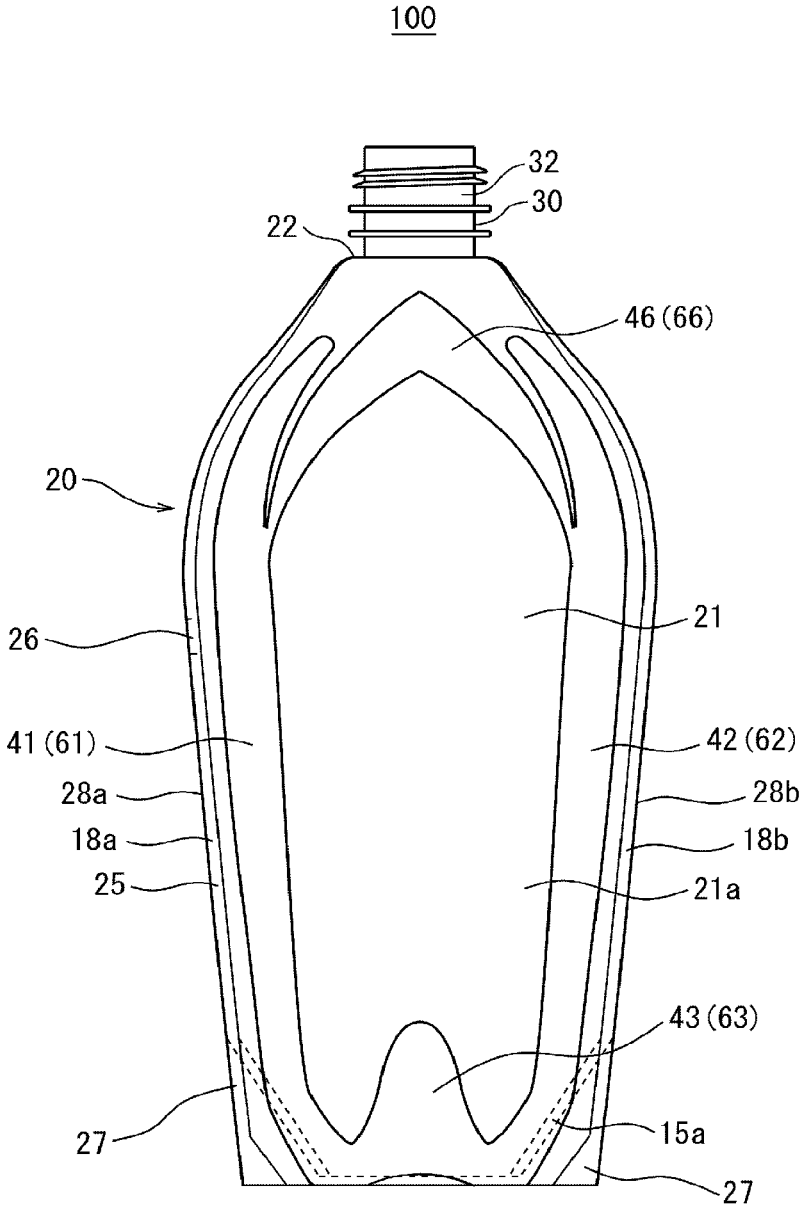

FIG. 25 is a front elevation illustrating a container according to Modified Example 7 of the first embodiment.

Figure 26B:
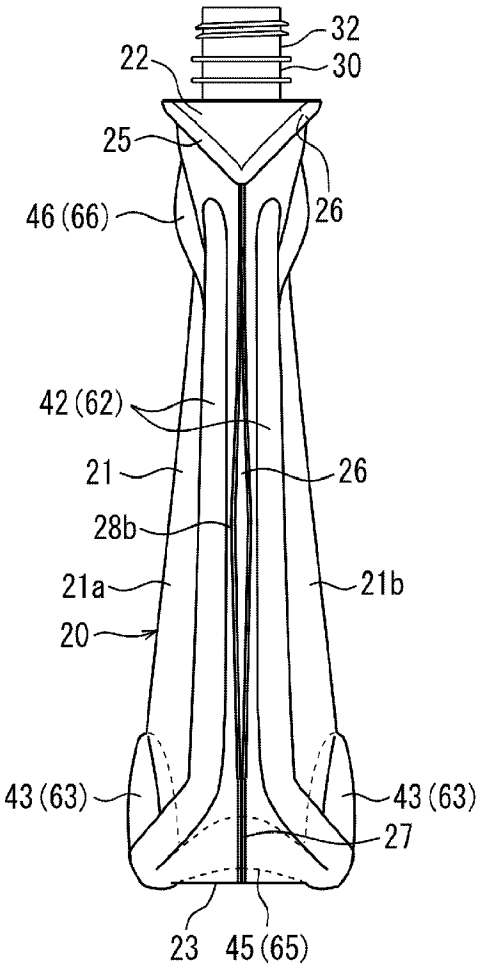
Figure 26A:
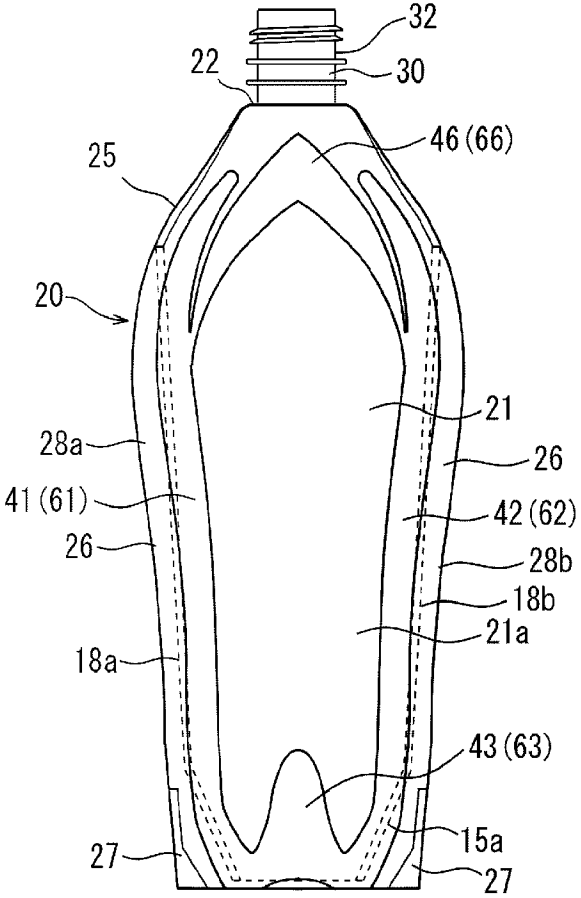

FIG. 26(*a*) is a front elevation illustrating a container of the second embodiment, and FIG. 26(*b*) is a right side elevation of the container of the second embodiment.

Figure 27:
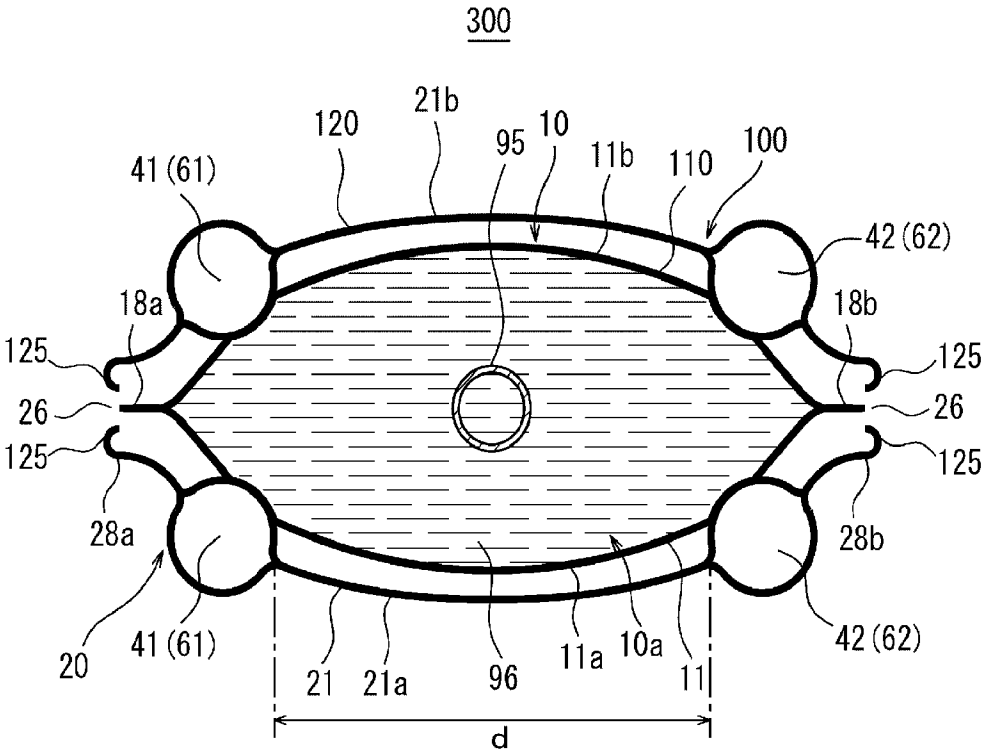

FIG. 27 is a schematic plane cross sectional view illustrating a packed article in container of a second embodiment.

Figure 28:
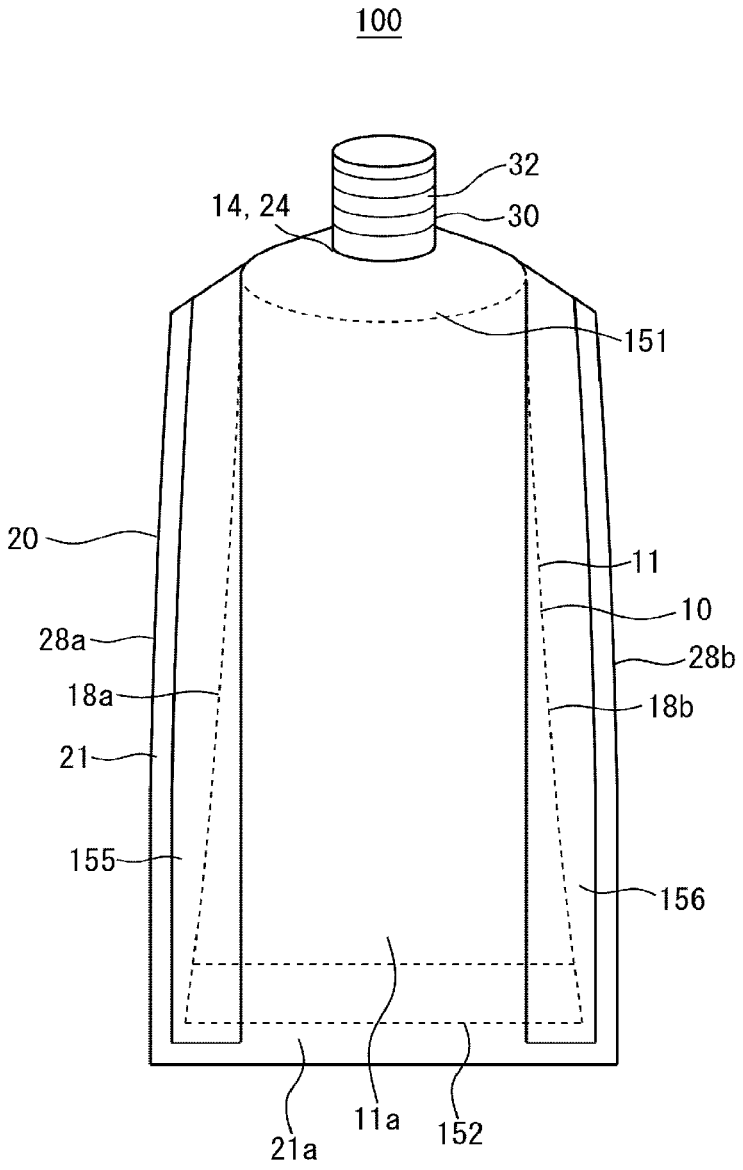

FIG. 28 is a schematic drawing illustrating a container of a third embodiment.

Figure 29:
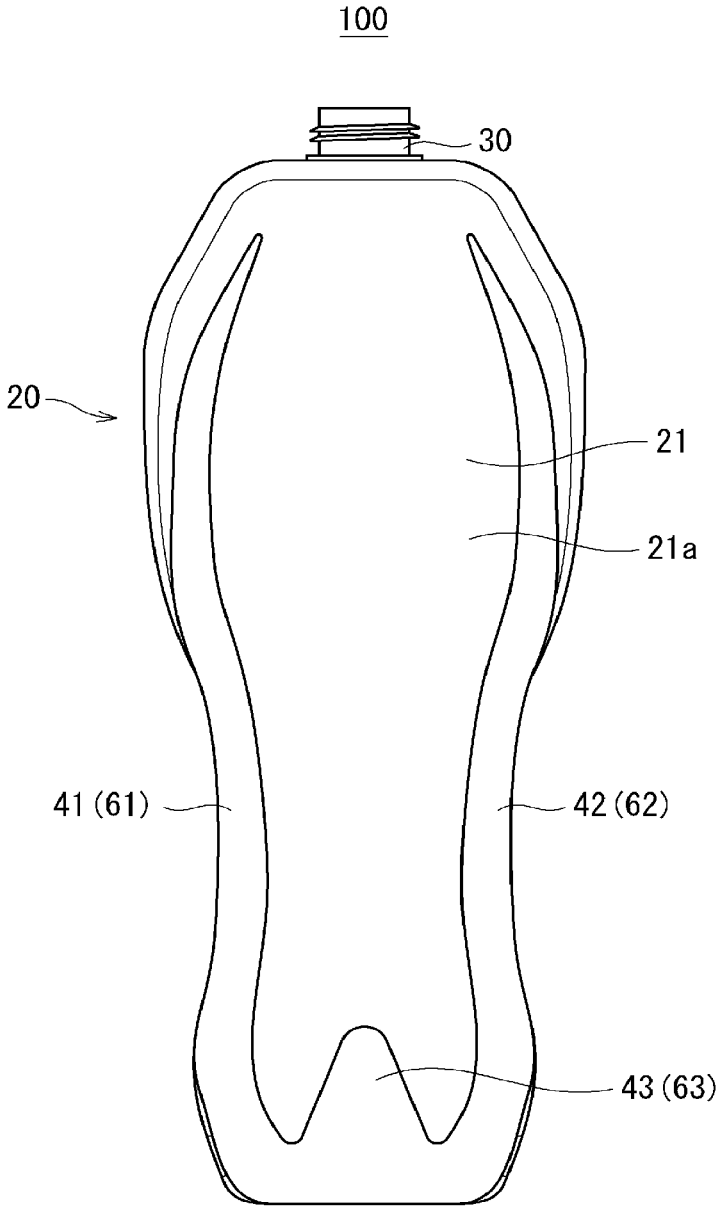

FIG. 29 is a front elevation illustrating a container of a fourth embodiment.

Figure 30:
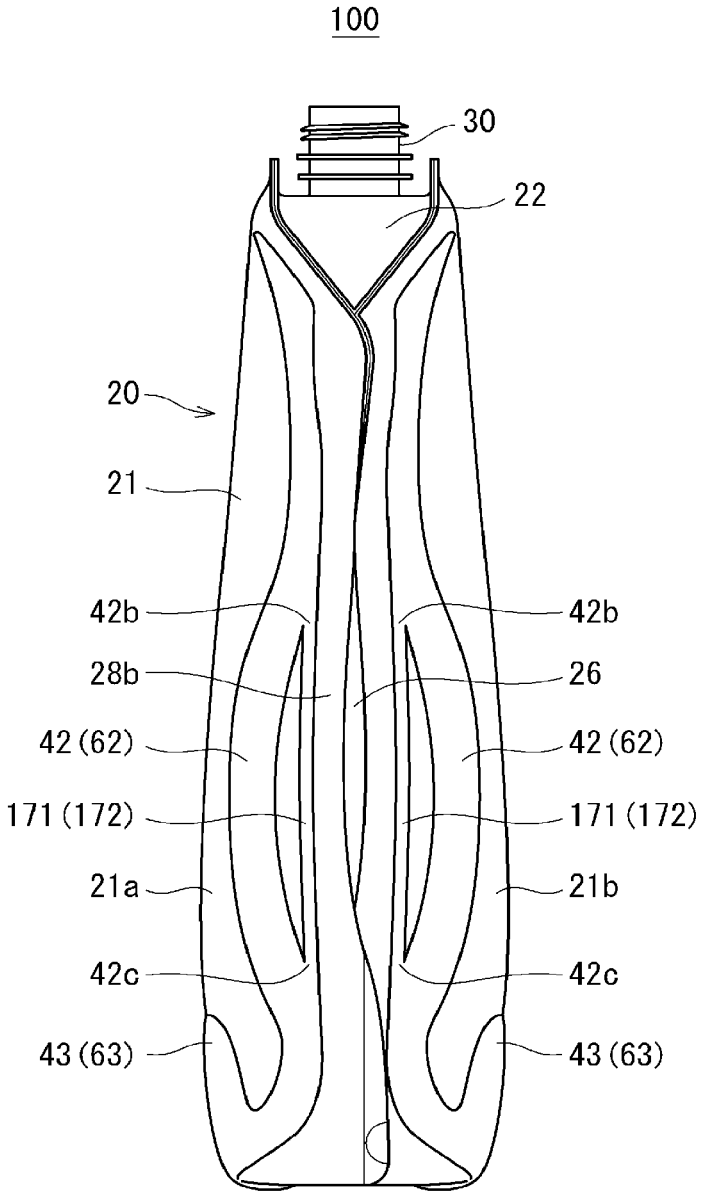

FIG. 30 is a right side elevation illustrating the container of the fourth embodiment.

Figure 31:
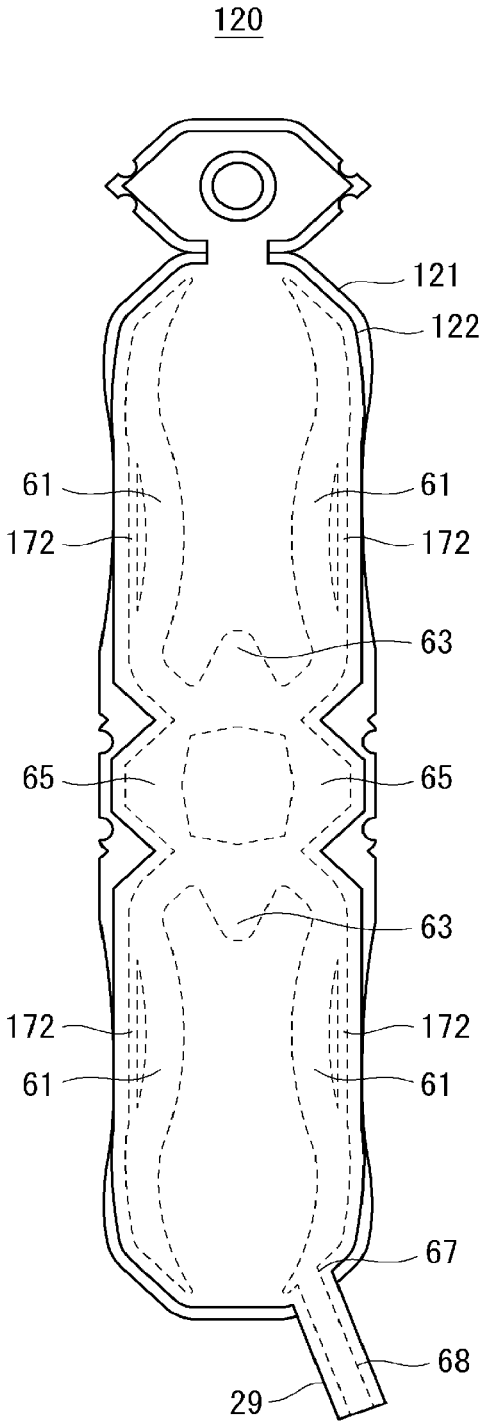

FIG. 31 is a plan view illustrating a cover-forming sheet member that composes a cover of the container of the fourth embodiment.

DETAILED DESCRIPTION OF THE INVENTION

The container having the filler enclosing part, like that described in Patent Document 1, tends to cause residence of an article, at a portion adjoining the filler enclosing part, that is, a recess (step) at the boundary between the filler enclosing part and the other part, and there is room for improvement concerning the dischargeability of the article.

For the purpose of suppressing the residence of the article, at the boundary between the filler enclosing part and the other part, it may otherwise be feasible to provide an inner container for accommodating the article, inside the cover having the filler enclosing part. Such inner container is, however, assumed to be less collapsible, still leaving a room for improvement in terms of dischargeability of the article.

This invention relates to a container having a filler enclosing part, and excels in dischargeability of an article, packed article in such container, a sheet for container, a container forming sheet, and a method for manufacturing a container.

Preferred embodiments of this invention will be explained below, referring to attached drawings. Note that, in all drawings, all similar constituents will be given the same reference numerals or symbols, so as to suitably avoid repetitive explanation.

First Embodiment

First of all, the first embodiment will be explained referring to FIG. 1 to FIG. 20.

Figure 2:
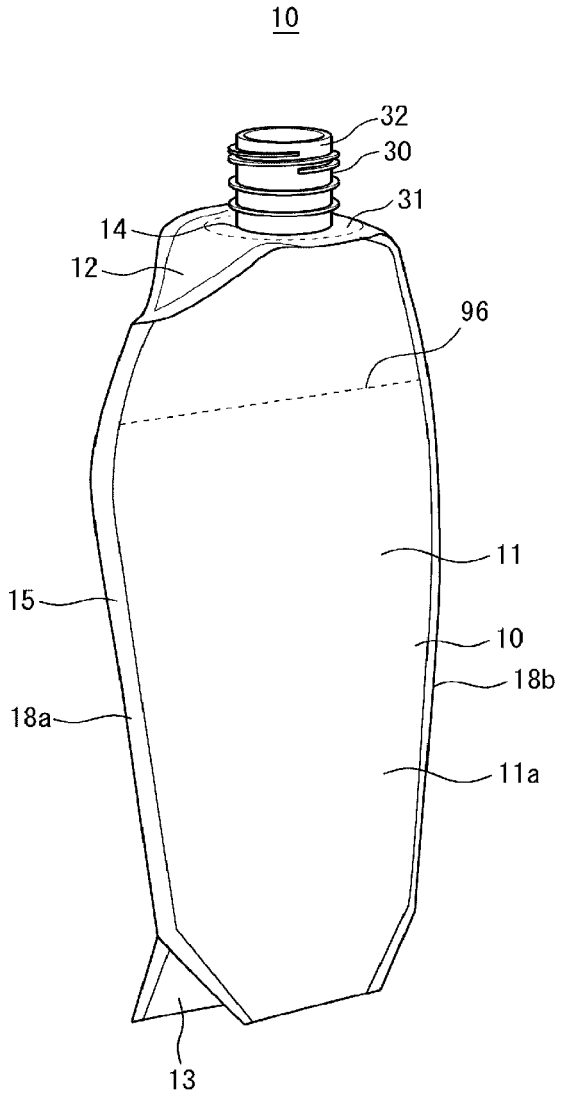
FIG. 2 is a perspective view illustrating an inner container of the container of the first embodiment.

FIG. 2 is a perspective view illustrating a container 100 in which the cover 20 is not shown.

Figure 10C:
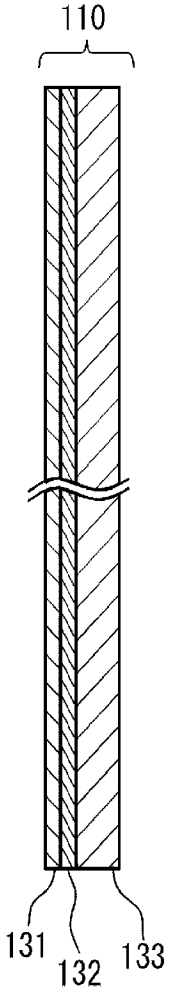
FIG. 10(*a*) is a plan view (inner surface side) illustrating an inner container forming sheet that composes the inner container of the container of the first embodiment, FIG. 10(*b*) is a plan view (outer surface side) illustrating the inner container forming sheet that composes the inner container of the container of the first embodiment, and FIG. 10(*c*) is a cross sectional view illustrating the inner container forming sheet that composes the inner container of the first embodiment.
Figure 10B:
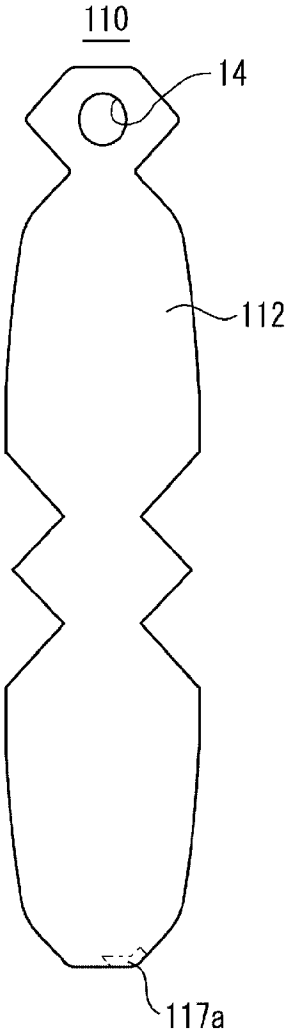
Figure 10A:
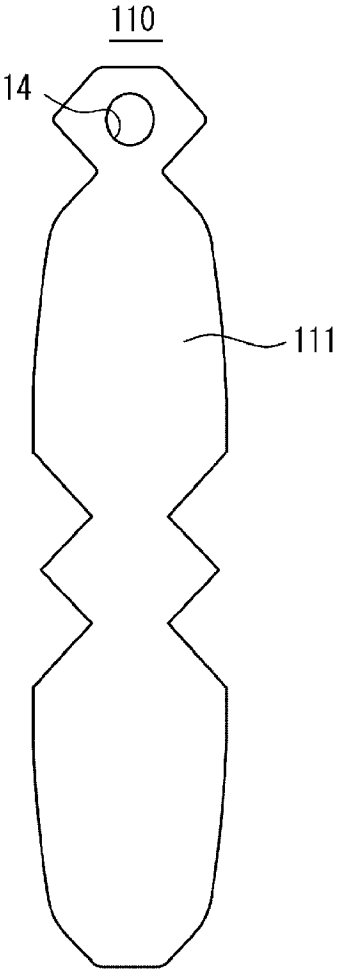

Of FIG. 10(*a*) and FIG. 10(*b*), FIG. 10(*a*) shows the surface (inner surface 111) of the inner container-forming sheet member 110, which serves as an interior face of the inner container 10, meanwhile FIG. 10(*b*) shows the surface (outer surface 112) of the inner container-forming sheet member 110, which serves as an exterior face of the inner container 10.

Figure 11:
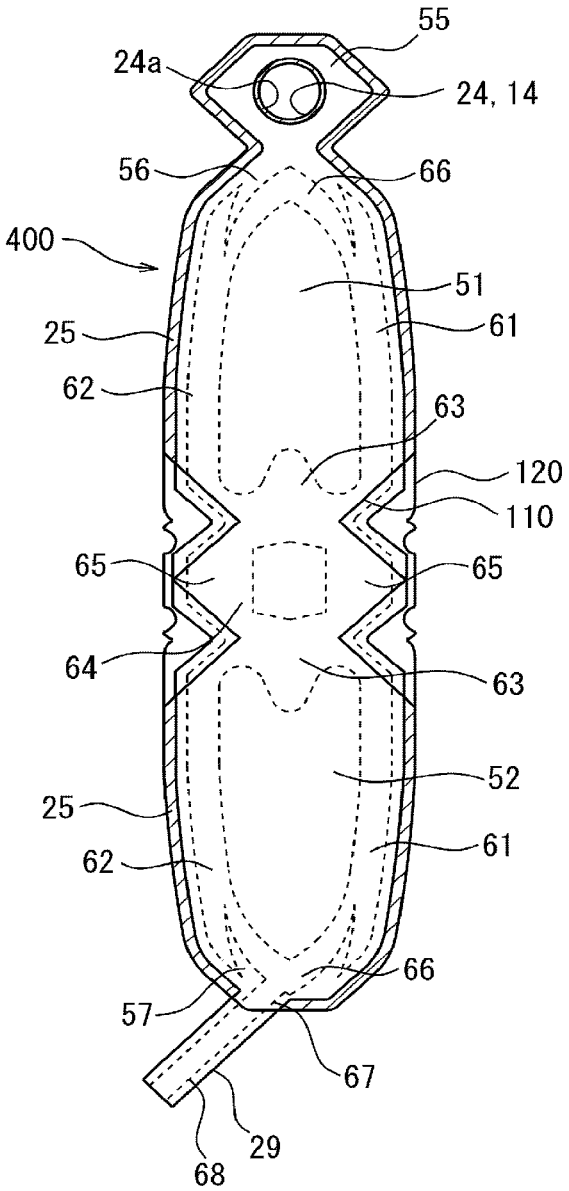
FIG. 11 is a plan view illustrating the container forming sheet that composes the container of the first embodiment, with a portion later formed into an accommodating area for accommodating an article, directed to the top.
Figure 12:
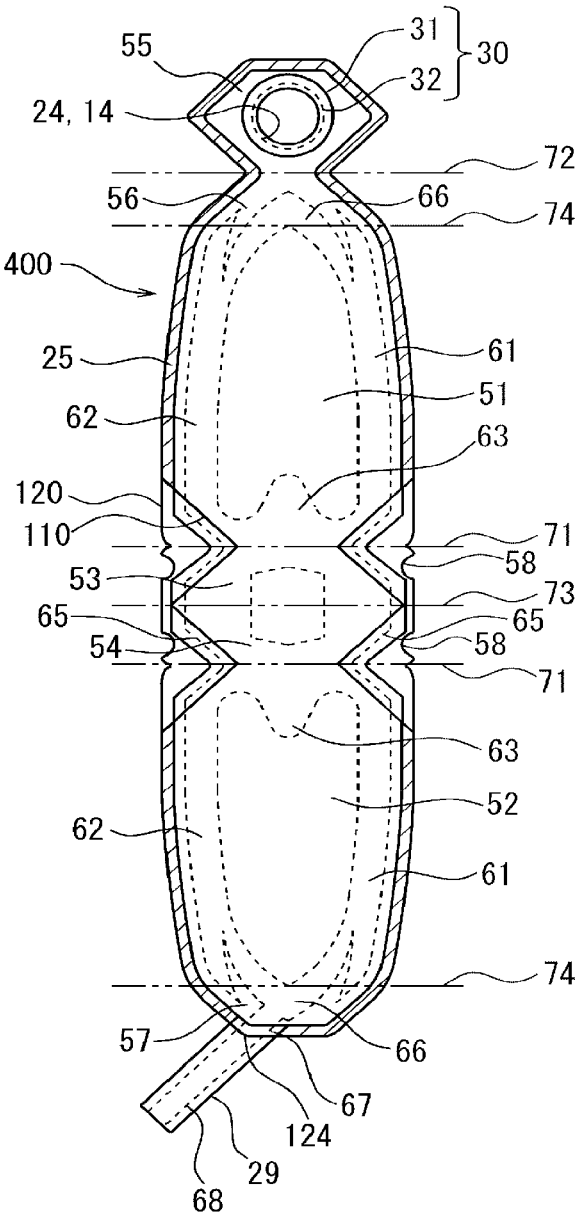
FIG. 12 is a plan view illustrating the container forming sheet (with spout) that composes the container of the first embodiment, with the portion later formed into the accommodating area for accommodating the article, directed to the top.

In each of FIG. 11 and FIG. 12, a part of a container forming sheet 400, later formed into an accommodating area 10*a* (see FIG. 16(*a*)) for accommodating the article, is directed to the top. FIG. 11 illustrates the container forming sheet 400 before being provided with a spout 30, and FIG. 12 illustrates the container forming sheet 400 provided with the spout 30.

In FIG. 19, illustration of filler enclosing parts 45 is omitted.

In FIG. 20, illustration of filler enclosing parts 43 is omitted, but draws the inner container 10 with a solid line, and portions of the contour of the filler enclosing part 45 located in the behind (on the far side of) the trunk 11 of the inner container 10 are drawn with a broken line.

The container 100 of this embodiment has an inner container 10 (FIG. 2) that accommodates an article 96 (FIG. 2), with an opening 14 (FIG. 2) through which the article 96 can be discharged; and a cover 20 that is composed of a cover-forming sheet member 120 given by lamination of a plurality of film layers (for example, two film layers namely a first film layer 121 and a second film layer 122), and covers the inner container 10. The cover-forming sheet member 120 has a film region in which the plurality of film layers are attached to each other, and filler enclosing parts 41, 42, 43, 45, 46, 47 in which a filler is enclosed between the plurality of film layers, and bulges in the thickness direction of the cover-forming sheet member 120 than the film region. The container 100 has an outer air introducing part 26 (FIG. 5, FIG. 6(*a*)) through which the outer air is introduced between the outer surface of the inner container 10 and the inner surface of the cover 20.

Hence, the capacity of the inner container 10 may easily be shrunk independently of the cover 20 (see FIG. 16(*b*)). In this way, the article 96 in the inner container 10 may easily be discharged, and is suppressed from remaining in the inner container 10.

In this embodiment, the cover 20 has a bottom gusset 23, and the container 100 is designed in a self-standing form. However, in the present invention, the container is not limited to the self-standing form, but may be a form (pillow type) intended for use while being laid down, rather than being stand alone.

Types of the article 96 are not specifically limited. The article 96 is typically exemplified by shampoo, hair rinse, body soap, detergent, softener, beverage and food.

The article 96 may be liquid (including paste), or may be solid (for example, particle (including granule), or powder). Note, however, that the container 100 in this embodiment has a pumping cap 90, and the article 96 is liquid.

When the article 96 is liquid, the article 96 preferably has a viscosity, for example at 30° C., of equal to or larger than 1 mPa·s and equal to or smaller than 120,000 mPa·s (measured using a B-type viscometer, such as Viscometer TV-10 or Viscometer TVB-10 from Toki Sangyo Co., Ltd.), which is more preferably equal to or larger than 1 mPa·s and equal to or smaller than 60,000 mPa·s.

In this embodiment, the inner container 10 is made up into a shape illustrated in FIG. 2, by folding the inner container forming sheet member 110 illustrated in FIG. 10(*a*), FIG. 10(*b*) and FIG. 10(*c*), and by attaching the peripheral parts of the inner container forming sheet member 110 to each other.

Note, however, in the present invention, that the inner container is not always necessarily composed of the sheet member, but may be formed by blow molding.

Figure 1:
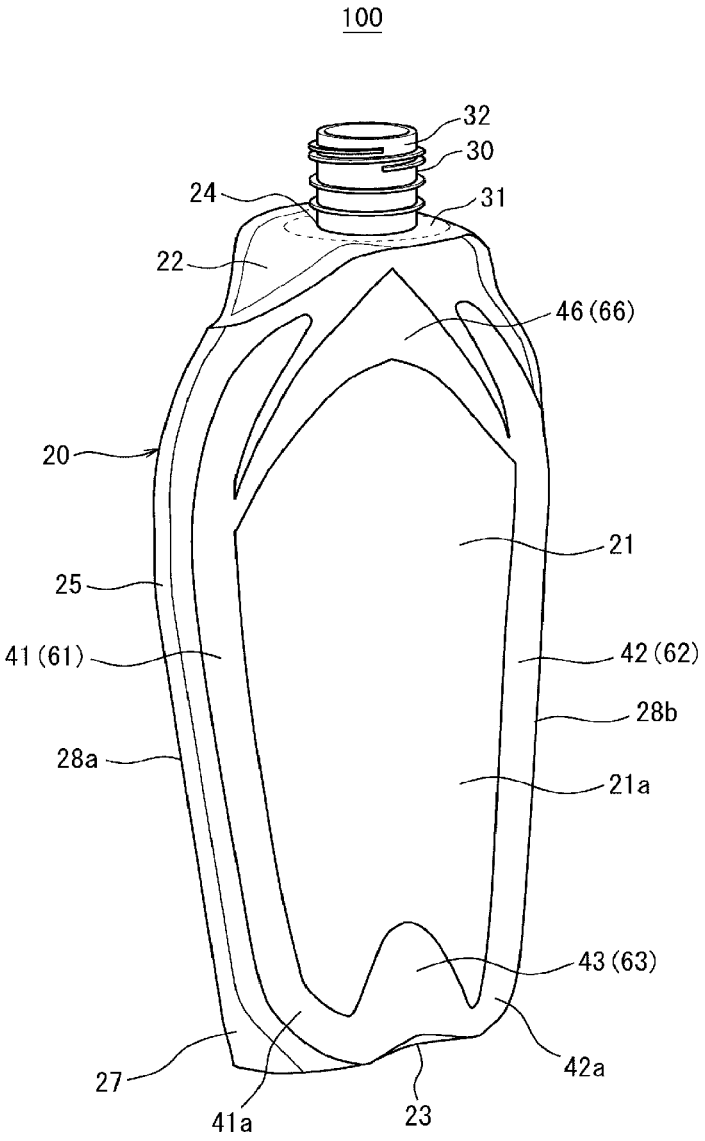
FIG. 1 is a perspective view illustrating a container of a first embodiment.

In this embodiment, the cover 20 covers the entire portion of the inner container 10 illustrated in FIG. 2, so as to form the outer surface of the container 100 (see FIG. 1).

However, in the present invention, the cover 20 may cover at least a part of the inner container 10.

Preferably, the cover 20 surrounds the circumference (girth) of the trunk 11 of the inner container 10.

Preferably, the cover 20 covers the inner container 10 over a range from an end on the opening 14 side of the inner container 10 to an end (a bottom gusset 13, in this embodiment) opposite to the opening 14 side of the inner container 10.

In this embodiment, all of filler enclosing parts (filler enclosing parts 41, 42, 43, 45, 46, 47) of the cover-forming sheet member 120 are formed in a merged manner. Note, however, that the cover-forming sheet member 120 in the present invention may have a plurality of filler enclosing parts independent from each other.

Besides the filler enclosing part and the film region, the cover-forming sheet member 120 may have a region where the plurality of film layers (for example, the first film layer 121 and the second film layer 122) are kept unattached and have no filler between the plurality of film layers.

In this embodiment, the outer air introducing part 26 is formed between the cover 20 and the inner container 10.

However, the present invention is not limited to this example, and the outer air introducing part 26 may solely owned by the cover 20. In this case, the outer air introducing part 26 may, for example, be an opening formed in the cover 20.

In this embodiment, the container 100 has a single outer air introducing part 26. In other words, the outer air introducing part 26 is formed at one point of the container 100. However, the present invention is not limited to this example, instead allowing that the container 100 may have a plurality of outer air introducing parts 26.

Figure 4:
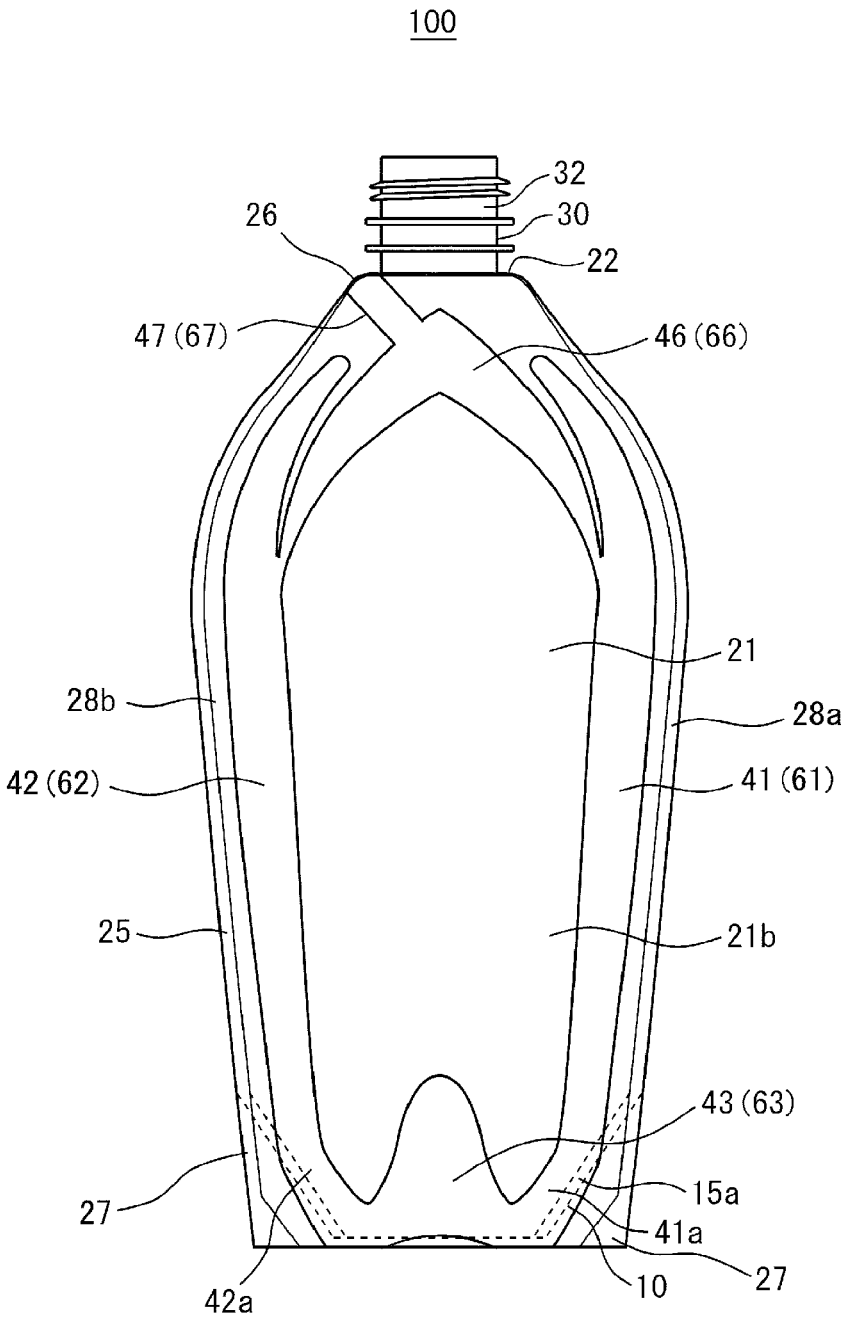
FIG. 4 is a rearview of the container of the first embodiment.

This embodiment will further be detailed below. Note that all explanations on positional relations (vertical relation, etc.) of the individual constituents of the container 100 and a packed article in container 300 (FIG. 15) will be made assuming that the container 100 is kept stand as illustrated in FIG. 3 and FIG. 4, and that the packed article in container 300 is kept stand as illustrated in FIG. 15, unless otherwise specifically stated. However, that the positional relations explained here not always coincide with the positional relations when the container 100 and the packed article in container 300 are used or manufactured.

The front face side of the container 100 and the packed article in container 300 will be referred to as "front", the rear face side of the container 100 and the packed article in container 300 will be referred to as "rear", the right side of the container 100 and the packed article in container 300 when viewed from the front face (the right hand side in FIG. 3, FIG. 15) will be referred to as "right", and the left side of the container 100 and the packed article in container 300 when viewed from the front face (the left hand side in FIG. 3, FIG. 15) will be referred to as "left".

However, that the positional relations of the individual constituents of the container 100 and the packed article in container 300 will occasionally be explained based on the positional relations in the individual drawings.

As illustrated in FIG. 2, the inner container 10 has a top gusset 12, which is a gusset formed at the upper end of the inner container 10, a bottom gusset 13 (inner container bottom part) (FIG. 7) which is a gusset formed at the bottom part of the inner container 10, and the trunk 11 (inner container trunk) which is a part of the inner container 10 between the top gusset 12 and the bottom gusset 13.

The inner space of the inner container 10 serves as the accommodating area 10*a* (FIG. 16(*a*), FIG. 16(*b*)) that accommodates the article 96.

The top gusset 12 has an opening 14 through which the article 96 in the accommodating area 10*a* can be discharged. As described later, in the top gusset 12, for example, there is provided a cylinder part 32 of the spout 30 so as to extend through the opening 14. Hence, in more details, the article 96 in the accommodating area 10*a* of the inner container 10 may be discharged through the spout 30 that extends through the opening 14.

Here, the top gusset 12 and the bottom gusset 13 are arranged at the opposing ends of the inner container 10, respectively. In other words, the bottom gusset 13 is formed at the end, opposite to the opening 14, of the inner container 10.

The trunk 11 has a first main surface part 11*a* (first inner container main surface part) and a second main surface part 11*b* (second inner container main surface part) (FIG. 16(*a*), FIG. 16(*b*)), opposed to each other with the accommodating area 10*a* that accommodates the article 96 therebetween.

The trunk 11 has a pair of inner container peripheral parts 18*a*, 18*b*, each extending from the top gusset 12 side towards the bottom gusset 13 side, and are arranged side by side. That is, the inner container peripheral part 18*a* is a left peripheral part (left side marginal part) of the trunk 11, meanwhile the inner container peripheral part 18*b* is a right peripheral part (right side marginal part) of the trunk 11.

As described above, the inner container 10 is composed of the inner container forming sheet member 110. In this embodiment, at least one of the pair of inner container peripheral parts 18*a*, 18*b* is a sealed part 15 in which parts of the inner container forming sheet member 110 are attached to each other. In this embodiment, both of the pair of inner container peripheral parts 18*a*, 18*b* constitute the sealed part 15.

The present invention is, however, not limited to this example, instead allowing that at least one of the left and right sides of the inner container 10 may have formed therein a gusset composed of other sheet member, arranged between a part that composes the first main surface part 11*a* and apart that composes the second main surface part lib in the inner container forming sheet member 110.

In this case, at least one of the left or right side of the inner container 10 is provided with (but not the sealed part 15 in which parts of the inner container forming sheet member 110 are attached to each other) a sealed part, in which, a part composes the first main surface part 11*a* of the inner container forming sheet member 110 and a front edge of the other sheet member are attached to each other, and a sealed part, in which, a rear edge of the other sheet member and a part composes the second main surface part 11*b* of the inner container forming sheet member 110 are attached to each other.

The first main surface part 11*a* and the bottom gusset 13 are mutually connected at the lower end of the inner container 10. Similarly, the second main surface part 11*b* and the bottom gusset 13 are mutually connected at the lower end of the inner container 10.

The first main surface part 11*a* and the second main surface part 11*b* are mutually connected at the inner container peripheral part 18*a*, and are also mutually connected at the inner container peripheral part 18*b*.

In the top gusset 12, for example, the level of height of the central part (in this embodiment, a part provided with the spout 30 described later) in the transverse direction of the inner container 10 is relatively high, and parts on both sides thereof are inclined downward toward the left and right ends of the inner container 10. Hence, the inner container 10 has a shape of sloping shoulders.

The parts of the inner container forming sheet member 110 are attached to each other in the sealed part 15 that resides at the boundary between the top gusset 12 and the trunk 11, in the sealed part 15 that resides in the inner container peripheral part 18*a* and the inner container peripheral part 18*b*, and in the sealed part 15 that resides at the boundary between the trunk 11 and the bottom gusset 13. Hence, the inner container 10 has a structure in which the accommodating area 10*a*, which is an inner space of the inner container 10, is tightly closed except for the opening 14. The attaching of the parts of the inner container forming sheet member 110 is performed, for example, by heat sealing.

Figure 5:
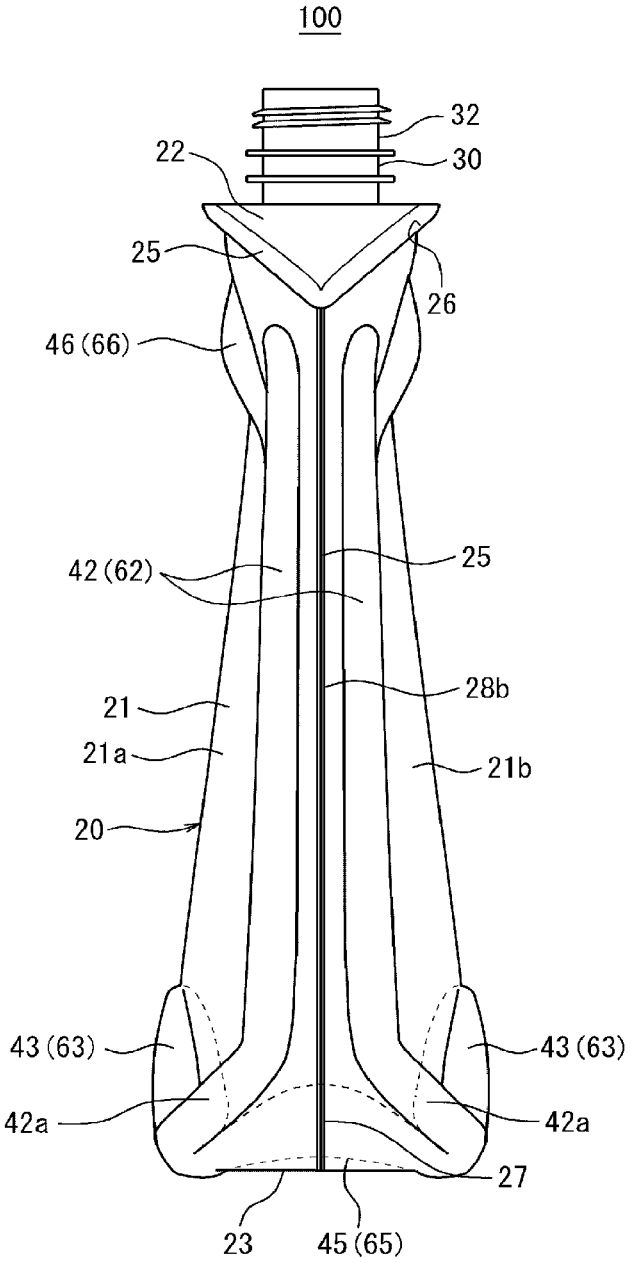
FIG. 5 is a right side elevation illustrating the container of the first embodiment.
Figure 6A:
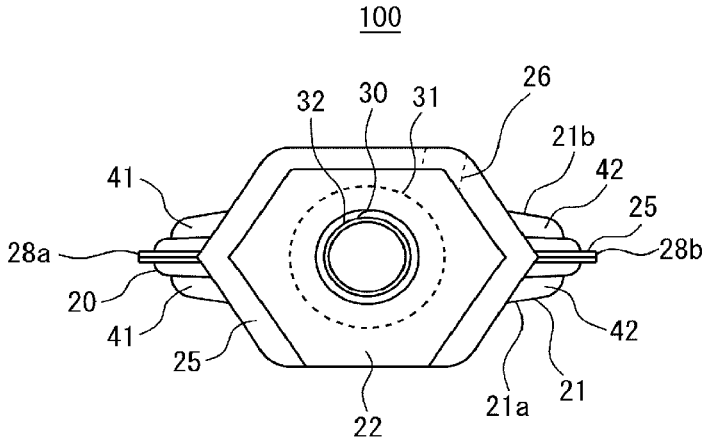
FIG. 6(*a*) is a plan view illustrating the container of the first embodiment, and FIG. 6(*b*) is a bottom view illustrating the container of the first embodiment.
Figure 6B:
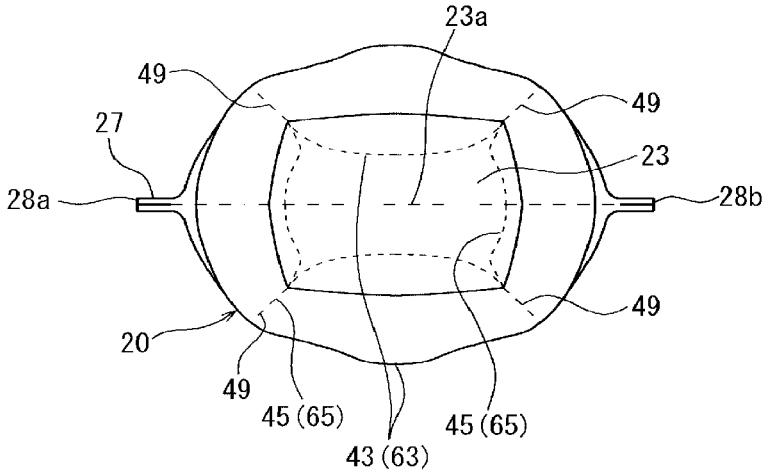

The cover 20 is formed into the shape illustrated in FIG. 1, FIG. 3 to FIG. 5, FIG. 6(*a*) and FIG. 6(*b*), by folding the cover-forming sheet member 120 shown in FIG. 9(*a*) and FIG. 9(*b*), and by attaching a peripheral part of the cover-forming sheet member 120 with other peripheral part of the cover-forming sheet member 120 or with a peripheral part of the inner container forming sheet member 110.

As illustrated in any one of FIG. 1, FIG. 3 to FIG. 5, FIG. 6(*a*) and FIG. 6(*b*), the cover 20 has a top gusset 22 which is a gusset formed at the upper end of the cover 20, the bottom gusset 23 (cover bottom part) which is a gusset formed at the bottom part of the cover 20, and the trunk 21 (cover trunk) which is a part of the cover 20 between the top gusset 22 and the bottom gusset 23. The bottom gusset 23 is a portion which will be opposed to a placement surface, when the container 100 is allowed to stand thereon in a self-standing manner, and is formed by a region of the cover-forming sheet member 120 hatched in FIG. 17.

The top gusset 22 has an opening 24 (FIG. 1) through which the article 96 in the accommodating area 10*a* of the inner container 10 can be discharged. As described later, the top gusset 22 has provided thereto the cylinder part 32 of the spout 30 so as to extend through the opening 24. Hence, in more details, the article 96 in the accommodating area 10*a* of the inner container 10 is discharged through the spout 30 that extends through the opening 14 of the top gusset 12 and through the opening 24 of the top gusset 22.

The trunk 21 has a first main surface part 21*a* (first cover main surface part) and a second main surface part 21*b* (second cover main surface part) opposed to each other with the inner container 10 therebetween.

The trunk 21 has a pair of cover peripheral parts 28*a*, 28*b*, each extending from the top gusset 22 side towards the bottom gusset 23 side, and are arranged side by side. That is, the cover peripheral part 28*a* is a left peripheral part (left side marginal part) of the trunk 21, meanwhile the cover peripheral part 28*b* is a right peripheral part (right side marginal part) of the trunk 21.

The first main surface part 21*a* and the bottom gusset 23 are mutually connected at the lower end of the cover 20. Similarly, the second main surface part 21*b* and the bottom gusset 23 are mutually connected at the lower end of the cover 20.

The first main surface part 21*a* and the second main surface part 21*b* are mutually connected at the cover peripheral part 28*a*, and are also mutually connected at the cover peripheral part 28*b*.

In the top gusset 22, for example, the level of height of the central part (in this embodiment, a part provided with the spout 30 described later) in the transverse direction of the cover 20 is relatively high, and parts on both sides thereof are inclined downward toward the left and right ends of the cover 20. Hence, the cover 20 has a shape of sloping shoulders.

The cover 20 is attached to the inner container 10 in a sealed part 25. That is, the sealed part 25 is an attaching part between the cover 20 and the inner container 10 (an attaching part between the cover-forming sheet member 120 and the inner container forming sheet member 110).

In more details, in the sealed part 25, a peripheral part of the cover-forming sheet member 120 and a peripheral part of the inner container forming sheet member 110 are attached to each other.

Meanwhile, in a sealed part 27, peripheral parts of the cover-forming sheet member 120 are attached to each other. That is, the sealed part 27 is an attaching part between the peripheral parts of the cover-forming sheet member 120.

In the sealed part 25 and the sealed part 27, the cover-forming sheet member 120 is attached to the inner container forming sheet member 110 and the cover-forming sheet member 120, whereby in the case of this embodiment, the cover 20 is formed in a container shape covering the entire portion of the inner container 10. In this embodiment, the cover 20 has a structure in which the inner space of the cover 20 is tightly closed except for the outer air introducing part 26 and the opening 24.

Attaching of the cover-forming sheet member 120 and the inner container forming sheet member 110 and attaching of parts of the cover-forming sheet member 120 are performed by, for example, heat sealing.

The container 100 is capable of self-standing, when the bottom gusset 23 is placed on a horizontal placement surface.

In more details, the top gusset 22 covers the top face side of the top gusset 12.

The trunk 21 surrounds the trunk 11. That is, the first main surface part 21*a* covers the front face side of the first main surface part 11*a*, meanwhile the second main surface part 21*b* covers the rear face side of the second main surface part lib.

The bottom gusset 23 covers the bottom face side of the bottom gusset 13.

Here, as described above, the top gusset 12 has the opening 14. Therefore, it can be said that the bottom gusset 23 (cover bottom part) closes the end, opposite to the opening 14 of the inner container 10, of the trunk 21 (cover trunk).

A peripheral part of the top gusset 22 and a peripheral part of the top gusset 12 of the inner container 10 are attached to each other; the boundary part of the first main surface part 21*a* adjoining the top gusset 22 and the boundary part of the first main surface part 11*a* adjoining the top gusset 12 are attached to each other; the boundary part of the second main surface part 21*b* adjoining the top gusset 22 and the boundary part of the second main surface part 11*b* adjoining the top gusset 12 are attached to each other; each of the left and right side marginal part (but excluding the lower end) of the first main surface part 21*a* and each of the left and right side marginal parts of the first main surface part 11*a* are attached to each other; each of the left and right side marginal parts (but excluding the lower end) of the second main surface part 21*b* and each of the left and right side marginal parts of the second main surface part 11*b* are attached to each other; and, in each of the left and right side marginal parts of the lower end part of the trunk 21, parts of the cover-forming sheet member 120 that composes the cover 20 are attached to each other.

As described above, the sealed part 25 includes a part in which a peripheral part of the top gusset 12 and a peripheral part of the top gusset 22 are attached to each other, a part in which a peripheral part of the first main surface part 11*a* and a peripheral part of the first main surface part 21*a* are attached to each other, and a part in which a peripheral part of the second main surface part 11*b* and a peripheral part of the second main surface part 21*b* are attached to each other. In other words, the sealed part 25 includes a part arranged around the circumference of the opening 14, and a part arranged to the cover peripheral part 28*a*, and a part arranged to the cover peripheral part 28*b*.

The sealed part 27 is arranged at the lower end of each of the cover peripheral part 28*a* and the cover peripheral part 28*b*.

As described above, in this embodiment, the cover 20 and the inner container 10 are partially attached to each other (the cover-forming sheet member 120 and the inner container forming sheet member 110 are partially attached to each other).

Hence, the inner container 10 is held by the cover 20, and thereby the inner container 10 (the inner container forming sheet member 110) is suppressed from creasing even if it is made thin, and the inner container 10 will more easily be collapsed flatly. Hence, the residence of the article 96 in the inner container 10 will be suppressed.

The cover 20 and the inner container 10 are preferably attached to each other at two or more points.

In more details, in this embodiment, as described above, the sealed part 25 includes the part in which the cover 20 and the inner container 10 are attached to each other in the peripheral part of the top gusset 12. In other words, at around the circumference of the opening 14 of the inner container 10, the cover 20 and the inner container 10 are attached to each other.

Hence, the inner container 10 is prevented from being disabled to discharge the article 96 due to clogging in the vicinity of the opening 14, and thereby the residence of the article 96 in the inner container 10 may be suppressed.

The circumference of the opening 14 may be a range over the entire perimeter of the opening 14, or may be a partial range around the opening 14.

The container 100 of the present invention is not limited to the structure the one exemplified above, such that the cover 20 and the inner container 10 are attached to each other in the peripheral part of the top gusset 12, but may have a structure in which the cover 20 and the inner container 10 are attached to each other at around the circumference of the opening 14 of the top gusset 12.

The cover 20 has the cover trunk (trunk 21) that includes the first cover main surface part (first main surface part 21*a*) and the second cover main surface part (second main surface part 21*b*) opposed to each other with the inner container 10 therebetween, the cover trunk has a pair of cover peripheral parts (cover peripheral part 28*a*, 28*b*), each extending from the side the opening 14 of the inner container 10 is arranged towards the opposite side, and are arranged side by side, and, in at least one of the pair of cover peripheral parts, the cover 20 and the inner container 10 are partially attached to each other.

Thereby, the inner container 10 is held by the cover 20, and will more easily be collapsed and flattened, and thereby the residence of the article 96 in the inner container 10 may be suppressed.

In this embodiment, the sealed part 25 is arranged at each of a part of the cover peripheral part 28*a*, and a part of the cover peripheral part 28*b*. However, in the present invention, the sealed part 25 may be arranged only at a part of either one of the cover peripheral part 28*a* or the cover peripheral part 28*b*.

Note that the present invention is not limited to this example, instead allowing that the cover 20 and the inner container 10 are non-attached over the entire portion (the cover 20 and the inner container 10 may not be attached to each other at all). However, even in this case, it is preferable that the inner container 10 is held inside the cover 20 by the cover 20.

In this embodiment, since the inner container forming sheet member 110 and the cover-forming sheet member 120 are left partially unattached to each other, the container 100 has the outer air introducing part 26 (FIG. 4, FIG. 5, FIG. 6(*a*)) through which the outer air is introduced inside the cover 20, that is, between the inner surface of the cover 20 and the outer surface of the inner container 10.

However, the present invention is not limited to such example, instead allowing that the outer air introducing part is formed as a result that parts of the cover-forming sheet member 120 are left partially unattached to each other; or that the outer air introducing part is given by a through-hole formed in the cover-forming sheet member 120 so as to pierce therethrough (a through-hole is formed in the cover 20 so as to penetrate the cover 20).

The portion of the container 100 where the outer air introducing part 26 is formed is not particularly limited. In this embodiment, the outer air introducing part 26 is formed, for example, between the upper end of the second main surface part 21*b* of the trunk 21 (a boundary part of the second main surface part 21*b* adjoining the top gusset 22), and the upper end of the second main surface part 11*b* of the trunk 11 (a boundary part of the second main surface part 11*b* adjoining the top gusset 12).

In this embodiment, the inner container-forming sheet member 110 is provided with the spout 30 (FIG. 12) before the inner container 10 is formed, and the cylinder part 32 of the spout 30 protrudes from the opening 14 of the inner container 10 (FIG. 2).

In more details, in this embodiment, the container forming sheet member 110 is attached to the cover-forming sheet member 120 before the cover 20 is formed, the inner container forming sheet member 110 is provided with the spout 30 (FIG. 12), and the cylinder part 32 of the spout 30 protrudes from the opening 24 of the cover 20 (FIG. 1).

The spout 30 is configured to include a base 31 with flat plate-like shape attached to the inner surface side of the inner container 10, and the cylinder part 32 that projects in one direction out from the base 31. The base 31 has a through-hole formed at the center thereof, and the inner space of the cylinder part 32 communicates with the through-hole of the base 31. The cylinder part 32 has a cylindrical form. The outer peripheral surface of the cylinder part 32 is threaded, hence the cylinder part 32 constitutes a male thread.

The accommodating area 10*a* of the inner container 10*a* can communicate with the outside of the container 100, through the through-hole of the base 31 and the inner space of the cylinder part 32 of the spout 30.

In this embodiment, the cylinder part 32 of the spout 30 is protruded to the outside of the container 100 through the opening 14 of the inner container 10 and the opening 24 of the cover 20, and the article 96 in the accommodating area 10*a* is discharged to the outside through the spout 30.

In this embodiment, the base 31 of the spout 30 is fixed by adhesion to the surface of the inner container forming sheet member 110, which will form the inner surface of the inner container 10. However, the present invention is not limited to such example. The base 31 may alternatively be arranged between the first film layer 121 and the second film layer 122 that compose the cover 20, and may be fixed by adhesion to at least one of the first film layer 121 and the second film layer 122. Still alternatively, the base 31 may be arranged between the outer surface of the inner container 10 and the inner surface of the cover 20, and may be fixed by adhesion to at least one of the outer surface of the inner container 10 and the inner surface of the cover 20.

In more details, the spout 30 of the container 100 has mounted thereto the pumping cap 90 illustrated in FIG. 15.

The pumping cap 90 has, for example, a cap 91 that screws with the cylinder part 32 of the spout 30, an upright cylinder 92 that projects upward from the cap part 91, a depressable part 93 that is provided at the top end of the upright cylinder 92 and accepts press down operation by the user, a nozzle 94 that projects nearly horizontally from the depressable part 93, and a liquid feeding tube 95 that communicates with the upright cylinder 92 and projects downward from the cap part 91.

In the state that the pumping cap 90 is mounted on the cylinder part 32 of the spout 30, by pressing down the depressable part 93, the article 96 is discharged to the outside through the upright cylinder 92 and the nozzle 94. When the depressable part 93 is released from the press-down operation and elevates, the article 96 inside the accommodating area 10*a* is sucked up through the liquid feeding tube 95.

The pumping cap 90 is attachable to and detachable from the cylinder part 32. After the article 96 in the container 100 was fully consumed, the pumping cap 90 may be attached to a new container 100 that contains the article 96 (packed article in sheet container 300), and may be used just like before. That is, while the container 100 that contains the article 96 (packed article in sheet container 300) might be disposable, the pumping cap 90 may be recycled.

The portion of the cover 20 where the filler enclosing part is formed is not particularly limited. In this embodiment, the cover 20 has, for example, the filler enclosing parts 41, 42, 43, 45, 46, 47 described below.

The filler enclosing part 41 extends vertically along the left peripheral part of the trunk 21, that is, the cover peripheral part 28*a*. The cover 20 has a pair of front and rear filler enclosing parts 41. That is, the filler enclosing part 41 is formed in each of the first main surface part 21*a* and the second main surface part 21*b*.

The filler enclosing part 42 extends vertically along the right peripheral part of the trunk 21, that is, the cover peripheral part 28*b*. The cover 20 has a pair of front and rear filler enclosing parts 42. That is, the filler enclosing part 42 is formed in each of the first main surface part 21*a* and the second main surface part 21*b*.

As shown in FIG. 3, a lower part 41*a* of the front filler enclosing part 41 is arranged in an inclined posture so that it shifts rightward as it goes down, meanwhile a lower part 42*a* of the front filler enclosing part 42 is arranged in an inclined posture so that it shifts leftward as it goes down.

As shown in FIG. 4, a lower part 41*a* of the rear filler enclosing part 41 is arranged in an inclined posture so that it shifts rightward as it goes down, meanwhile a lower part 42*a* of the filler enclosing part 42 is arranged in an inclined posture so that it shifts leftward as it goes down (FIG. 4 is a rear view, and is therefore laterally inverted from FIG. 3).

The filler enclosing part 43 is laid across the bottom gusset 23 and the trunk 21.

The cover 20 has a pair of front and rear filler enclosing parts 43. That is, the cover 20 has the front filler enclosing part 43 that lies across the bottom gusset 23 and the first main surface part 21*a*, and the rear filler enclosing part 43 that lies across the bottom gusset 23 and the second main surface part 21*b*.

In more details, a part of the front filler enclosing part 43 arranged in the first main surface part 21*a* is arranged at the center, in the width direction, of the first main surface part 21*a* at the lower end of the first main surface part 21*a*. The lower end of the front filler enclosing part 43 is connected to each of the lower end of the front filler enclosing part 41 and the lower end of the front filler enclosing part 42. Hence, the front filler enclosing part 41 and the front filler enclosing part 42 communicate with each other, through the front filler enclosing part 43.

Similarly, a part of the rear filler enclosing part 43 arranged in the second main surface part 21*b* is arranged at the center, in the width direction, of the second main surface part 21*b* at the lower end of the second main surface part 21*b*. The lower end of the rear filler enclosing part 43 is connected to each of the lower end of the rear filler enclosing part 41 and the lower end of the rear filler enclosing part 42. Hence, the rear filler enclosing part 41 and the rear filler enclosing part 42 communicate with each other, through the front filler enclosing part 43.

Each filler enclosing part 43 has a chevron shape which projects more largely upward, as it goes closer to the center in the transverse direction.

Also the filler enclosing part 45 is laid across the bottom gusset 23 and the trunk 21.

The cover 20 has the pair of left and right filler enclosing parts 45.

The left filler enclosing part 45 is arranged between the lower part 41*a* of the front filler enclosing part 41, and the lower part 41*a* of the rear filler enclosing part 41.

The right filler enclosing part 45 is arranged between the lower part 42*a* of the front filler enclosing part 42, and the lower part 42*a* of the rear filler enclosing part 42 (FIG. 5).

Each of the filler enclosing parts 45 has a chevron shape which projects more largely upward, as it goes closer to the center in the front-rear direction.

The lower end of the left filler enclosing part 45 is connected to each of the left end of the lower end of the front filler enclosing part 43, and to the left end of the lower end of the right rear filler enclosing part 43.

Similarly, the lower end of the right filler enclosing part 45 is connected to each of the right end of the lower end of the front filler enclosing part 43, and the right end of the lower end of the rear filler enclosing part 43.

Hence, the front filler enclosing part 43 and the rear filler enclosing part 43 communicate with each other through the left filler enclosing part 45, and through the right filler enclosing part 45.

Now, an aggregate of the lower ends of the pair of front and rear filler enclosing parts 43, and the lower ends of the pair of left and right filler enclosing parts 45 is arranged to form a loop along the peripheral part of the bottom gusset 23, as illustrated in FIG. 6(*b*).

Figure 7:
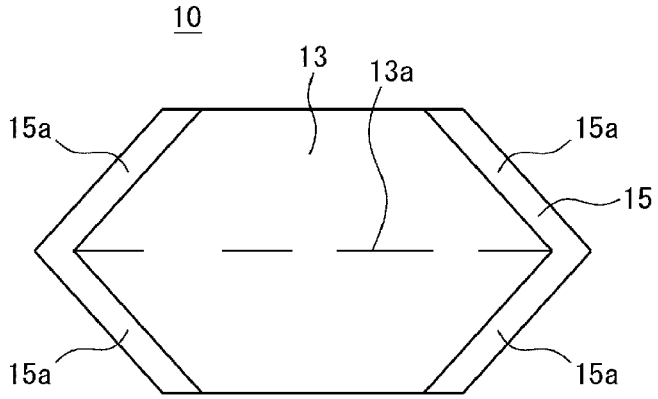
FIG. 7 is a bottom view illustrating the inner container of the container of the first embodiment.

As shown in FIG. 7, the peripheral part of the bottom gusset 13 has formed therein the sealed part 15. The sealed part 15 formed in the peripheral part of the bottom gusset 13 includes four bottom gusset peripheral sealed parts 15*a* each linearly extends.

Meanwhile, as illustrate in FIG. 6(*b*), each gap 49 formed between every two adjoining filler enclosing parts, among the pair of front and rear filler enclosing parts 43 and the pair of left and right filler enclosing parts 45, is arranged at each of four corners of the bottom gusset 23.

At each gap 49, a single bottom gusset peripheral sealed part 15*a* is sandwiched between the filler enclosing part 43 and the filler enclosing part 45.

The filler enclosing part 46 is arranged at the center in the width direction of the trunk 21 in the upper part of the trunk 21.

The cover 20 has the pair of front and rear filler enclosing parts 46.

The front filler enclosing part 46 is connected to each of the upper part of the front filler enclosing part 41, and the upper part of the front filler enclosing part 42. Hence, the front filler enclosing part 41 and the front filler enclosing part 42 communicate with each other through the front filler enclosing part 46.

Similarly, the rear filler enclosing part 46 is connected to each of the upper part of the rear filler enclosing part 41, and the upper part of the rear filler enclosing part 42. Hence, the rear filler enclosing part 41 and the rear filler enclosing part 42 communicate with each other through the rear filler enclosing part 46.

As shown in FIG. 4, the filler enclosing part 47 communicate, for example, with the upper end of the rear filler enclosing part 46, and extends from the filler enclosing part 46 towards the outer air introducing part 26.

Here, in this embodiment, all filler enclosing parts 41, 42, 43, 45, 46, 47 owned by the container 100 communicate with each other.

The filler enclosing part 46 is sealed, for example, at a position overlapping with the outer air introducing part 26.

The filler may be fluid (gas or liquid), solid (for example, particulate, resin pellet, etc.) or semi-solid (for example, foam material, etc.), and is preferably a gas such as air.

Next, an exemplary layer structure of each of the first film layer 121 and the second film layer 122 that compose the cover-forming sheet member 120 will be explained.

Figure 8B:
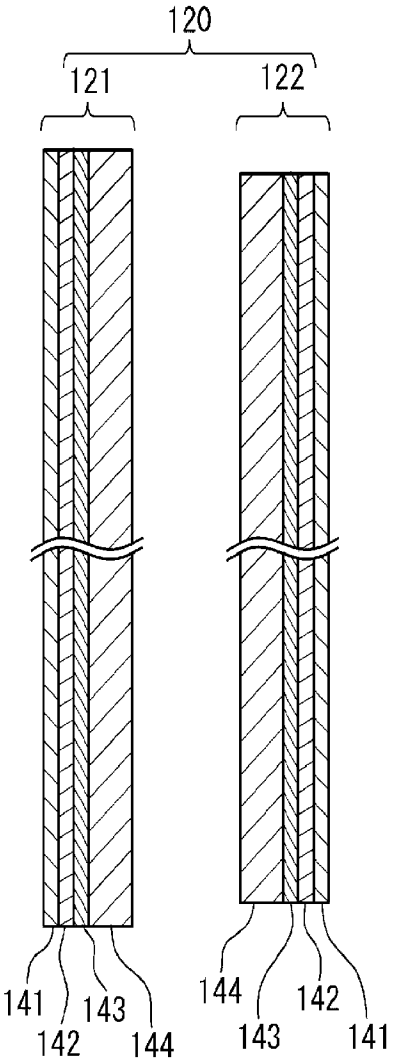
FIG. 8(*a*) is an exploded view (plan view) illustrating a cover-forming sheet member that composes a cover of the container of the first embodiment, and FIG. 8(*b*) is an exploded view (cross sectional view) illustrating the cover-forming sheet member that composes the cover of the container of the first embodiment.
Figure 8A:
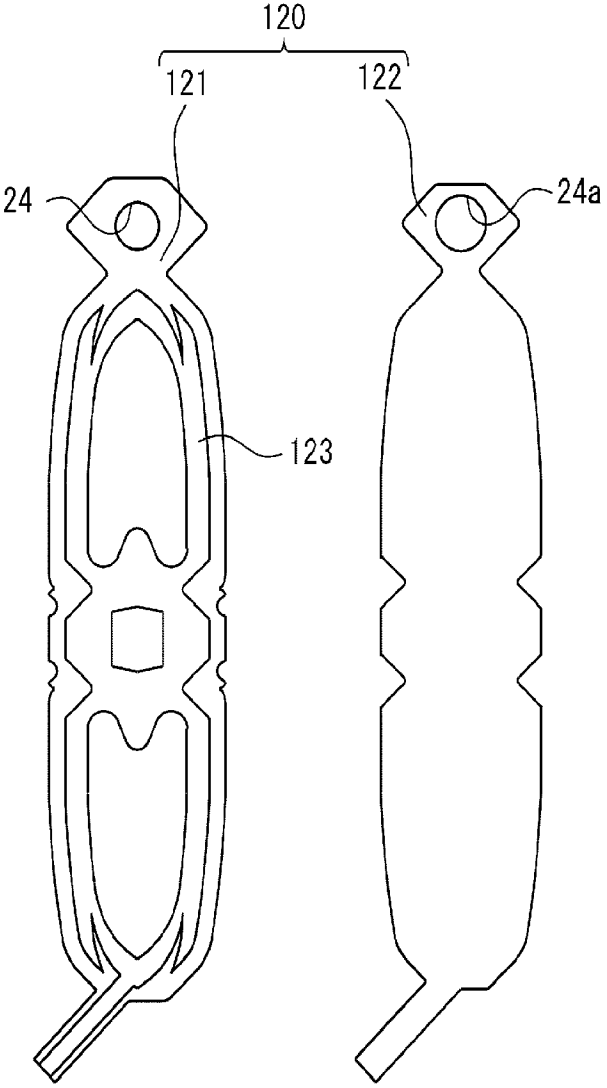

The first film layer 121 is a film layer that composes the outer surface side of the cover 20. As illustrated in FIG. 8(*b*), the first film layer 121 is formed by laminating, for example, a first layer 141, a second layer 142, a third layer 143, and a fourth layer 144 in this order.

The first layer 141 is made, for example, of polyethylene terephthalate (PET) or oriented nylon (ONy).

The second layer 142 is, for example, a transparent evaporated PET layer made of polyethylene terephthalate, with silica and alumina vapor-deposited on one surface thereof (the surface on the side of the first layer 141).

The third layer 143 is, for example, made of oriented nylon.

The fourth layer 144 is, for example, made of linear low-density polyethylene (LLDPE).

Although the thickness of these layers is not specifically limited, the first layer 141 may be 12 μm thick, the second layer 142 may be 12 μm thick, the third layer 143 may be 15 μm thick, and the fourth layer 144 may be 40 μm, for example.

Major function of the first layer 141 is exemplified by provision of glossiness and printability of the cover 20, as well as provision of rigidity of the cover 20.

Major function of the second layer 142 is exemplified by provision of gas barrier performance.

Major function of the third layer 143 is exemplified by provision of pinhole resistance.

Major function of the fourth layer 144 is exemplified by provision of heat sealability with the second film layer 122, heat sealability between parts of the first film layers 121, and sealability with the inner container forming sheet member 110.

The second film layer 122 is a film layer that composes the inner surface side of the cover 20.

The layer structure employable in the second film layer 122 may be same as that in the first film layer 121.

However, materials for composing the first film layer 121 and the second film layer 122 are not limited to those exemplified above.

The second film layer 122 may have a layer structure different from that in the first film layer 121.

For example, a linear low-density polyethylene (LLDPE) layer, same as that composing the fourth layer 144, may be provided as the outermost first layer 141. With such layer structure, parts of the second film layer 122 may be heat-sealed at the sealed part 27, or the second film layer 122 and the inner container forming sheet member 110 may be heat-sealed in the sealed part 25.

The cover-forming sheet member 120 is formed by stacking the first film layer 121 and the second film layer 122, and then attaching them to each other (for example, by heat sealing).

That is, the first film layer 121 and the second film layer 122 are stacked, so that the fourth layer 144 of the first film layer 121 is faced to the fourth layer 144 of the second film layer 122. While keeping this arrangement, the first film layer 121 and the second film layer 122 are mutually pressurized and heated, whereby the fourth layer 144 of the first film layer 121 and the fourth layer 144 of the second film layer 122 are heat-sealed to each other. The cover-forming sheet member 120 is formed in this way (see FIG. 9(*a*), FIG. 9(*b*)).

For example, in at least one or both of the first film layer 121 and the second film layer 122, a non-attaching part 123 (FIG. 8(*a*)) having been subjected to non-attaching treatment is formed on the surface(s) facing the other, so as to the first film layer 121 and the second film layer 122 (the fourth layer 144 of the first film layer 121 and the fourth layer 144 of the second film layer 122) will left partially unattached to each other, and thereby, the non-attached parts 61, 62, 63, 65, 66, 67, and 68 will be formed as illustrated in FIG. 9(*a*). The non-attaching part 123 may easily be formed by coating a non-attaching agent (so-called adhesion inhibitor) to a corresponded part and setting it in an adhesion inhibited state. The adhesion inhibitor may freely be selectable from those capable of inhibiting attaching between the first film layer 121 and the second film layer 122. As the adhesion inhibitor, suitably employable are printing inks used for offset printing, flexographic printing and letterpress printing; medium ink; and dedicated adhesion inhibition ink. Also thermosetting or UV-curable ink may suitably be used.

Area of formation of the non-attaching part 123 will be the non-attached parts (non-attached parts 61, 62, 63, 65, 66, 67, 68).

Of the non-attached parts, each non-attached part 61 corresponds to each filler enclosing part 41, each non-attached part 62 corresponds to each filler enclosing part 42, each non-attached part 63 corresponds to each filler enclosing part 43, each non-attached part 65 corresponds to each filler enclosing part 45, and the non-attached part 67 corresponds to the filler enclosing part 47. The non-attached part 68 will serve as an inlet through which the filler is introduced into each of the non-attached parts.

Each of the filler enclosing parts (filler enclosing parts 41, 42, 43, 45, 46, 47) are formed by attaching the first film layer 121 and the second film layer 122 to each other at the boundary between the non-attached part 68 and the non-attached part 67, while retaining the filler in the non-attached parts 61, 62, 63, 65, 66, 67 after introduced through the non-attached part 68.

Method for forming the non-attached parts 61, 62, 63, 65, 66, 67, 68 between the first film layer 121 and the second film layer 122 is not limited to the method exemplified above. For example, a die used for heat sealing of the first film layer 121 and the second film layer 122 may have formed therein a recess (groove) in an area corresponded to the non-attached parts 61, 62, 63, 65, 66, 67, 68. Alternatively, the first film layer 121 and the second film layer 122 may be heat-sealed, while placing therebetween a spacer layer composed of a non-heat sealable material (for example, resin layer such as PET layer).

As illustrated in FIG. 9(*a*), the first film layer 121 is formed slightly larger than the second film layer 122, and protrudes around the periphery of the second film layer 122. In other words, as illustrated in FIG. 9(*b*), in the peripheral part of the cover-forming sheet member 120, the fourth layer 144 of the first film layer 121 exposes.

In a part of the first film layer 121 used for composing the top gusset 22, there is formed the opening 24 through which the cylinder part 32 of the spout 30 is inserted (FIG. 8(*a*)). Meanwhile, in a part of the second film layer 122 used for composing the top gusset 22, there is formed an opening 24*a* which is slightly larger than the opening 24 (FIG. 8(*a*)). Hence, the fourth layer 144 of the first film layer 121 exposes around the circumference of the opening 24, and, inside of the opening 24*a* (see FIG. 9(*a*)).

Next, an exemplary layer structure of the inner container forming sheet member 110 will be explained.

As illustrated in FIG. 10(*c*), the inner container forming sheet member 110 is formed by laminating, for example, a first layer 131, a second layer 132 and a third layer 133 stacked in this order.

The first layer 131 is made, for example, of linear low-density polyethylene.

The second layer 132 is, for example, a transparent evaporated oriented nylon layer made of oriented nylon, with silica and alumina are vapor-deposited on one surface thereof (the surface on the side of the first layer 131).

The third layer 133 is made, for example, of linear low-density polyethylene.

Although the thickness of these layers is not specifically limited, the first layer 131 may be 25 μm thick, the second layer 132 may be 15 μm thick, and the third layer 133 may be 40 μm thick, for example.

Major function of the first layer 131 is exemplified by provision of heat sealability with the cover-forming sheet member 120.

Major function of the second layer 132 is exemplified by provision of gas barrier performance and pinhole resistance.

Major function of the third layer 133 is exemplified by provision of heat sealability between parts of the inner container forming sheet member 110.

The first layer 131 is arranged on the outer surface side of the inner container 10 (i.e., on the cover 20 side), meanwhile the third layer 133 is arranged on the inner surface side of the inner container 10 (i.e., on the accommodating area 10*a* side).

The inner container 10 is formed, by folding the inner container-forming sheet member 110 into a shape with the trunk 11, the top gusset 12 and the bottom gusset 13 above-described and then by attaching the peripheral parts of the third layer 133 of the inner container-forming sheet member 110 to each other.

Note that parts of the third layer 133 are not mutually attached in the region inside the peripheral part of the inner container-forming sheet member 110. In this way, the region where parts of the inner container-forming sheet member 110 are left unattached to each other, namely the accommodating area 10*a*, is formed inside the inner container 10.

Here, as shown in FIG. 10(*a*) and FIG. 10(*b*), the inner container-forming sheet member 110 has the opening 14 which is formed in an area for composing the top gusset 12. The opening 14 is formed, for example, into the same size with the opening 24, and is arranged so as to overlap with the opening 24. The opening 14 is slightly smaller than the opening 24*a*.

When the inner container-forming sheet member 110 and the cover-forming sheet member 120 are attached to each other as explained below, the inner container-forming sheet member 110 and the cover-forming sheet member 120 are left partially unattached to each other in the inlet-forming part 117*a* illustrated in FIG. 10(*b*), and thereby a third non-attached region 124 (FIG. 12) which serves as the outer air introducing part 26 is formed.

As illustrated in FIG. 11, the cover-forming sheet member 120 and the inner container-forming sheet member 110 are stacked, and partially attached to each other. In FIG. 11, an area where the cover-forming sheet member 120 and the inner container-forming sheet member 110 are mutually attached to each other is hatched.

That is, a peripheral part of the inner container forming sheet member 110 and a part of the first film layer 121 of the cover-forming sheet member 120 projecting around the periphery of the second film layer 122 are attached (for example by heat sealing) to each other, and, a marginal part around the opening 14 of the inner container forming sheet member 110 and a part of the first film layer 121 which located inside the opening 24*a* are attached (for example by heat sealing) to each other.

A sheet member that is composed of the cover-forming sheet member 120 and the inner container forming sheet member 110 will be referred to as the "container forming sheet 400", hereinafter.

In addition, as shown in FIG. 12, the container forming sheet 400 is provided with the spout 30. That is, the base 31 of the spout 30 is fixed by adhesion to the inner container forming sheet member 110 at a marginal part around the opening 14, for example.

As shown in FIG. 12, the container forming sheet 400 is configured to include a first main surface sheet part 51, a second main surface sheet part 52, a first bottom gusset sheet part 53, a second bottom gusset sheet part 54 and a top gusset sheet part 55, individually described below.

The first main surface sheet part 51 composes the first main surface part 11*a* of the inner container 10, and the first main surface part 21*a* of the cover 20. The first main surface sheet part 51 includes a top gusset attaching part 56.

The second main surface sheet part 52 composes the second main surface part 11*b* of the inner container 10, and the second main surface part 21*b* of the cover 20. The second main surface sheet part 52 includes a top gusset attaching part 57.

The first bottom gusset sheet part 53 and the second bottom gusset sheet part 54 compose the bottom gusset 13 of the inner container 10, and the bottom gusset 23 of the cover 20.

The top gusset sheet part 55 composes the top gusset 22 of the inner container 10, and the bottom gusset 23 of the cover 20.

Among these, the top gusset sheet part 55 is formed, for example, into a hexagonal shape (in more detail, a laterally oblong hexagonal shape).

The first main surface sheet part 51 shares one side with the top gusset sheet part 55, and is connected to the lower side of the top gusset sheet part 55 in FIG. 12.

A part of the first main surface sheet part 51, located above an area along a folding line 74 illustrated in FIG. 12, is the top gusset attaching part 56. The top gusset attaching part 56 is formed, for example, into a trapezoidal shape with the upper base shorter than the lower base. Meanwhile, a part of the first main surface sheet part 51, located below an area along the folding line 74, is formed for example in a vertically oblong rectangular shape.

The first bottom gusset sheet part 53 is a part which composes the bottom gusset 13 and the bottom gusset 23, together with the second bottom gusset sheet part 54. The first bottom gusset sheet part 53 and the second bottom gusset sheet part 54 have the same shape. Each of the first bottom gusset sheet part 53 and the second bottom gusset sheet part 54 has, for example, a laterally oblong rectangular shape. The transverse width of the first bottom gusset sheet part 53 and the second bottom gusset sheet part 54 is set equivalent to the transverse width of the lower end of the first main surface sheet part 51.

In FIG. 12, the first bottom gusset sheet part 53 is connected to the lower side of the first main surface sheet part 51, meanwhile the second bottom gusset sheet part 54 is connected to the lower side of the first bottom gusset sheet part 53.

In FIG. 12, the second main surface sheet part 52 is connected to the lower side of the second bottom gusset sheet part 54.

A part of the second main surface sheet part 52, located below an area along the folding line 74 shown in FIG. 12, is the top gusset attaching part 57.

The second main surface sheet part 52 is formed into a shape same as the first main surface sheet part 51.

However, that the second main surface sheet part 52 is provided integrally with a filler introducing part 29, for example. The filler introducing part 29 has formed therein the non-attached part 68 that reaches the outer edge of the filler introducing part 29. The non-attached part 68 communicates with the non-attached part 67.

In the filler introducing part 29, the first film layer 121 and the second film layer 122 have the same size, so that the first film layer 121 is not protruded around the periphery of the second film layer 122. In other words, in the filler inlet 29, the fourth layer 144 of the first film layer 121 is not exposed.

In FIG. 12, the base 31 of the spout 30 is located on this side of the top gusset sheet part 55, and the cylinder part 32 projects through the top gusset sheet part 55 and comes out therefrom, towards the far side. The base 31 may alternatively be disposed between the first film layer 121 and the second film layer 122.

As described above, the container forming sheet 400 has the inner container forming sheet member 110 that forms the inner container 10 after being folded and attached to each other at the peripheral parts thereof; the cover-forming sheet member 120 given by lamination of the plurality of film layers (for example two film layers, namely the first film layer 121 and the second film layer 122), on which the inner container forming sheet member 110 is stacked, and forms the cover 20 that covers the inner container 10; and the peripheral attached part (sealed part 25) in which a peripheral part of the cover-forming sheet member 120 and a peripheral part of the inner container forming sheet member 110 are attached to each other; the cover-forming sheet member 120 has the film region in which the plurality of film layers are attached to each other, and the non-attached region (non-attached parts 61, 62, 63, 65, 66, 67, 68) in which the plurality of film layers are left partially unattached to each other; the container forming sheet 400 has, in an inner region surrounded by the peripheral attached part (sealed part 25), the second non-attached region in which the cover-forming sheet member 120 and the inner container forming sheet member 110 are left unattached to each other; the container forming sheet has the third non-attached region 124 in which the cover-forming sheet member 120 and the inner container forming sheet member 110 are left unattached to each other partially in the direction the peripheral attached part (sealed part 25) extends; and, a gap formed between the cover-forming sheet member 120 and the inner container forming sheet member 110 in the second non-attached region is communicating with a space outside the container forming sheet 400 through the third non-attached region 124.

Figure 13:
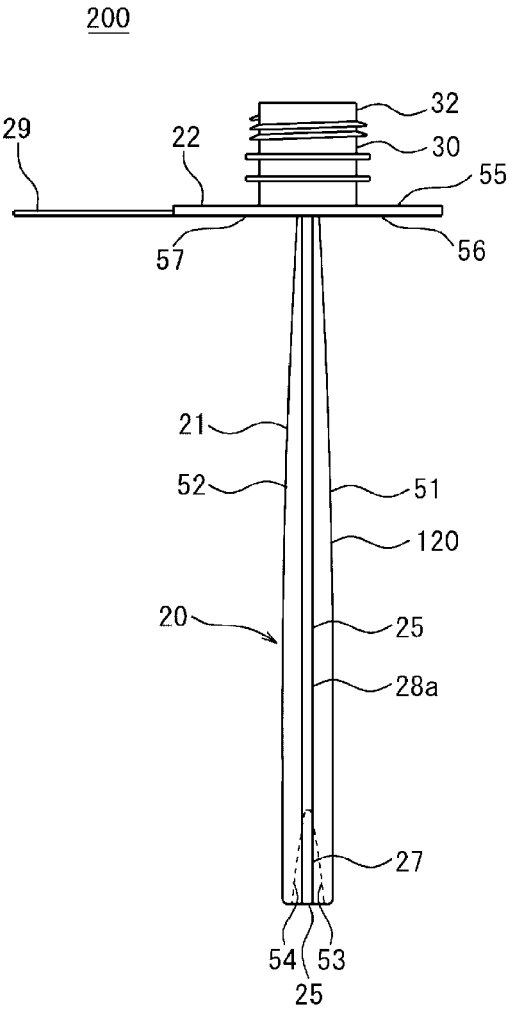
FIG. 13 is a side elevation illustrating a sheet for container of the first embodiment.
Figure 14B:
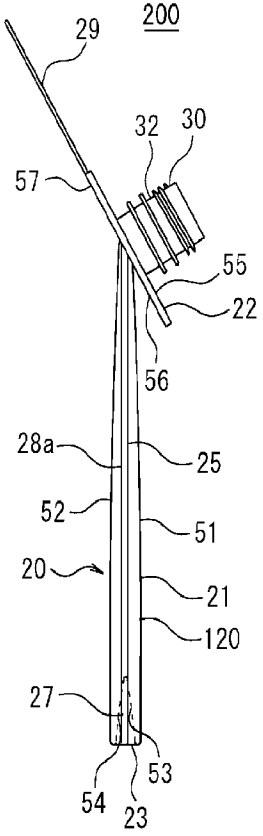
FIG. 14(*a*) is a front elevation illustrating a folded state of the sheet for container of the first embodiment, and FIG. 14(*b*) is a side elevation illustrating the folded state of the sheet for container of the first embodiment.
Figure 14A:
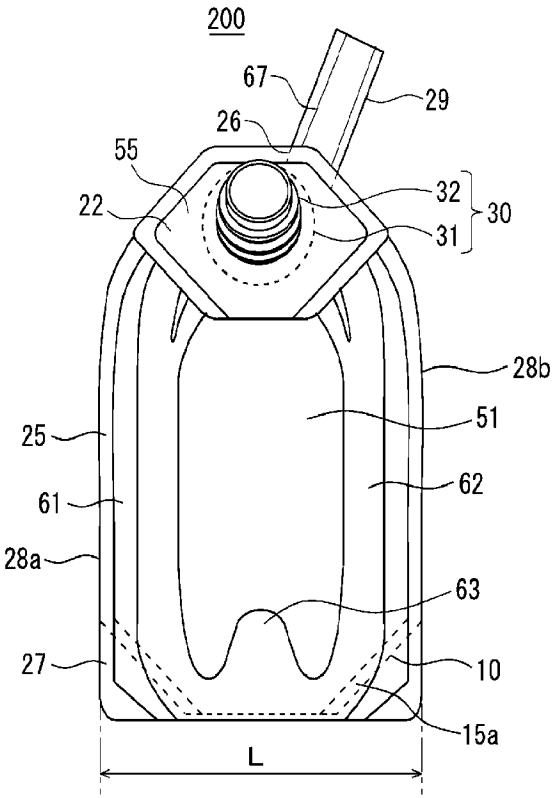

The sheet for container 200 (FIG. 13, FIG. 14(*a*), FIG. 14(*b*)) is formed by folding the container forming sheet 400, and by attaching (typically by heat sealing) the peripheral parts of the inner container forming sheet member 110 to each other.

More specifically, the container-forming sheet 400 is heat sealed to form the sheet for container 200, while being valley-folded along two folding lines 71 and one folding line 72 illustrated in FIG. 12, and mountain-folded at a folding line 73 and two folding lines 74.

The valley folding means a way of folding making the sheet convex towards the far side in FIG. 12, whereas the mountain folding means a way of folding making the sheet convex towards this side in FIG. 12.

One of the two folding lines 71 lies on the boundary between the first main surface sheet part 51 and the first bottom gusset sheet part 53, and the other lies on the boundary between the second main surface sheet part 52 and the second bottom gusset sheet part 54.

The folding line 72 lies on the boundary between the top gusset sheet part 55 and the first main surface sheet part 51 (the boundary between the top gusset sheet part 55 and the top gusset attaching part 56).

The folding line 73 lies on the boundary between the first bottom gusset sheet part 53 and the second bottom gusset sheet part 54.

One of the two folding lines 74 lies on the boundary between the top gusset attaching part 56 of the first main surface sheet part 51 and the other part of the first main surface sheet part 51, meanwhile, the other one lies on the boundary between the top gusset attaching part 57 of the second main surface sheet part 52 and the other part of the second main surface sheet part 52.

In the state that the container forming sheet 400 is folded in this way, a half part of the top gusset sheet part 55 (the lower half as shown in FIG. 12) and the top gusset attaching part 56 overlap with each other; the other part of the top gusset sheet part 55 (the upper half as shown in FIG. 12) and the top gusset attaching part 57 overlap with each other; the first bottom gusset sheet part 53 and the second bottom gusset sheet part 54 overlap with each other; the first bottom gusset sheet part 53 and the lower end part of the first main surface sheet part 51 overlap with each other; the second bottom gusset sheet part 54 and the lower end part of the second main surface sheet part 52 overlap with each other; and, a part of the first main surface sheet part 51 excluding the top gusset attaching part 56, and a part of the second main surface sheet part 52 excluding the top gusset attaching part 57 overlap with each other.

When the container forming sheet 400, kept folded in this way, is heat-sealed, the half part of the top gusset sheet part 55 (the lower half as shown in FIG. 12) and the top gusset attaching part 56 are attached to each other; the other part of the top gusset sheet part 55 (the upper half as shown in FIG.

12) and the top gusset attaching part 57 are attached to each other; the first bottom gusset sheet part 53 and the lower end part of the first main surface sheet part 51 are attached to each other; the second bottom gusset sheet part 54 and the lower end part of the second main surface sheet part 52 are attached to each other; and, the first main surface sheet part 51 and the second main surface sheet part 52 are attached to each other.

Here, the part attached to the second main surface sheet part 52 in the first main surface sheet part 51 is, the part excluding the top gusset attaching part 56 and a part of the first main surface sheet part 51 which overlaps the first bottom gusset sheet part 53.

Similarly, the part attached to the first main surface sheet part 51 in the second main surface sheet part 52 is, the part excluding the top gusset attaching part 57 and a part of the second main surface sheet part 52 which overlaps the second bottom gusset sheet part 54.

Here, as illustrated in FIG. 12, each of first bottom gusset sheet part 53 and the second bottom gusset sheet part 54 has notched parts 58 formed on the left and right ends thereof.

Hence, in the state that the container-forming sheet 400 folded as described above, parts of the first main surface sheet part 51 (second main surface sheet part 52) opposed to the individual notched parts 58 are opposed directly to the second main surface sheet part 52 (first main surface sheet part 51), without placing the first bottom gusset sheet part 53 and the second bottom gusset sheet part 54 therebetween. Therefore, by heat-sealing the container-forming sheet 400 as described above, the lower end part of the first main surface sheet part 51 and the lower end part of the second main surface sheet part 52 are locally heat sealed through the notched parts 58.

By heat-sealing the container-forming sheet 400 in this way, the sealed part 15 is formed, and concurrently the inner container 10 is formed, and the sealed part 27 is formed to concurrently form the cover 20 that covers the inner container 10. Thus, the sheet for container 200 illustrated in FIG. 13, FIG. 14(*a*) and FIG. 14(*b*) is formed up.

As described above, the sheet for container 200 has the inner container 10 that accommodates the article 96, with the opening 14 through which the article 96 can be discharged; and the cover 20 that is composed of the cover-forming sheet member 120 given by lamination of the plurality of film layers (for example, two film layers, namely the first film layer 121 and the second film layer 122), and covers the inner container 10; the cover-forming sheet member 120 has the film region in which the plurality of film layers are attached to each other, and the non-attached region (non-attached parts 61, 62, 63, 65, 66, 67, 68) in which the plurality of film layers are left partially unattached to each other; and the sheet for container 200 has the outer air introducing part 26 (FIG. 14(*a*)) through which the outer air is introduced between the outer surface of the inner container 10 and the inner surface of the cover 20.

In the sheet for container 200, the cover 20 has the cover trunk (trunk 21) that includes the first cover main surface part (first main surface part 21*a*) and the second cover main surface part (second main surface part 21*b*) opposed to each other with the inner container 10 therebetween; the cover trunk has the pair of cover peripheral parts 28*a*, 28*b*, each extending from the side the opening 14 of the inner container 10 is arranged towards the opposite side, and are arranged side by side, the non-attached region includes the first non-attached region (non-attached part 61) that extends along one (cover peripheral part 28*a*) of the pair of cover peripheral parts 28*a*, 28*b*, and the second non-attached region (non-attached part 62) that extends along the other one (cover peripheral part 28*b*) of the pair of cover peripheral parts 28*a*, 28*b*; and, a size (distance L in FIG. 14(*a*)) of the inner container in the direction from the first non-attached region to the second non-attached region, is larger than the distance between the first non-attached region and the second non-attached region.

Here, the distance between the first non-attached region (non-attached part 61) and the second non-attached region (non-attached part 62) is given by the shortest distance between the first non-attached region and the second non-attached region in the direction from the first non-attached region to the second non-attached region (the direction the first non-attached region and the second non-attached region oppose; (transverse direction in FIG. 14(*a*))).

The size of the inner container in the direction from the first non-attached region to the second non-attached region, namely distance L in FIG. 14(*a*), is given by the distance between the outer periphery of the cover peripheral part 28*a* and the outer periphery of the cover peripheral part 28*b*.

The sheet for container 200 has the tubular filler introducing part 29 that projects out from the cover 20. The non-attached part 68 of the filler introducing part 29 also serves as an introducing part through which the filler is introduced into spaces within each of the non-attached regions 61, 62, 63, 65, 66 and 67. Location of the filler introducing part 29 is not specifically limited. In this embodiment, for example, the filler introducing part 29 is disposed so that the filler introducing part 29 protrudes from the outer air introducing part 26.

FIG. 13 illustrates the top gusset 22 (and the top gusset 12, not illustrated) laid orthogonally to the trunk 21 (and the trunk 11, not illustrated). When the container-forming sheet 400 is heat-sealed, the sheet will be held as illustrated in FIG. 13, with the half part of the top gusset sheet part 55 and the top gusset attaching part 56 held by dies (not illustrated), with the other part of the top gusset sheet part 55 and the top gusset attaching part 57 held by the dies, and, also with the first main surface sheet part 51, the second main surface sheet part 52, the first bottom gusset sheet part 53 and the second bottom gusset sheet part 54 held by the dies.

FIG. 14(*a*) and FIG. 14(*b*) illustrate a state in which the sheet for container 200 is bent so that the top gusset attaching part 56 is overlapped with the other part of the first main surface sheet part 51. In this embodiment, the sheet for container 200 kept in the thus-bent state is fed from a process for manufacturing the sheet for container 200, to a process for enclosing the article 96 into the inner container 10.

After the sheet for container 200 is formed by heat-sealing the container forming sheet 400 as described above, the filler (air, for example) is introduced through the non-attached part 68 of the filler introducing part 29, into each of the non-attached parts 61, 62, 63, 65, 66, 67. As a consequence, each of the non-attached parts 61, 62, 63, 65, 66, 67 is expanded to form the filler enclosing parts 41, 42, 43, 45, 46, 47, thereby adding rigidity to the cover 20.

That is, the filler is enclosed between the first film layer 121 and the second film layer 122 in each of the non-attached parts 61, 62, 63, 65, 66, 67, and thereby the filler enclosing parts 41, 42, 43, 45, 46, 47 are formed.

As a result of expansion of each of the non-attached parts 61, 62, 63, 65, 66, 67, for example, the trunk 21 bulges also in the front-rear direction (see FIG. 5, FIG. 6(*a*), FIG. 6(*a*)).

After each of the filler enclosing parts 41, 42, 43, 45, 46, 47 are formed, for example, a part of the filler enclosing part 47 adjoining the non-attached part 68 is suitably sealed (that is, the filler enclosing parts 41, 42, 43, 45, 46, 47 are sealed, and the filler is enclosed in each of the filler enclosing parts 41, 42, 43, 45, 46, 47). In this way, the filler is prevented from leaking from each of the filler enclosing parts 41, 42, 43, 45, 46, 47.

The filler introducing part 29 is cut off at the base part.

The container 100 is thus manufactured.

As descried above, the method for manufacturing the container of this embodiment includes preparing an inner container forming sheet member 110 for composing the inner container 10; preparing the cover-forming sheet member 120 for composing the cover 20, given by lamination of a plurality of film layers, and including a film region in which the plurality of film layers are attached to each other, and a non-attached region in which the plurality of film layers are left partially unattached to each other; arranging the cover-forming sheet member 120 and the inner container forming sheet member 110 in a stacked manner; folding the cover-forming sheet member 120 and the inner container forming sheet member 110 and attaching peripheral parts of the inner container forming sheet member 110 to each other, to form the inner container 10, and make the cover 20 composed of the cover-forming sheet member 120 covers the inner container 10, and an outer air introducing part 26 through which the outer air can be introduced between the outer surface of the inner container 10 and the inner surface of the cover 20 is formed between the cover 20 and the inner container 10 or formed in the cover 20; and enclosing the filler into the non-attached region.

The pressure inside each of the filler enclosing parts 41, 42, 43, 45, 46, 47 is not particularly limited, but it is preferably higher than the atmospheric pressure, and can be set to, for example, 10 kPa or higher and 500 kPa or lower.

As a method of sealing the filler enclosing part, for example, there is a method that the non-attaching treatment is not performed at the part of the filler enclosing part 47 adjoining the non-attached part 68 so that the first film layer 121 and the second film layer 122 can be heat-sealed to each other; and heat-seal is not performed on that part in the process of manufacturing the container-forming sheet 400 and in the process of manufacturing the sheet for container 200; and heat-seal is performed on that part after the filler is enclosed.

The article 96 is then enclosed through the cylinder part 32 of the spout 30 into the accommodating area 10*a*, thereby the container 100 filled with the article 96, or the packed article in container 300, may be obtained.

As described above, the packed article in container 300 of this embodiment has container 100 of this embodiment, and the article 96 accommodated in the accommodating area 10*a*.

There is no particular limitation on the temporal order between the timing of filling of the filler into each of the filler enclosing parts 41, 42, 43, 45, 46, 47 and the timing of accommodating of the article 96 into the accommodating area 10*a*. The article 96 may be accommodated in the accommodating area 10*a* after enclosing the filler into each of the filler enclosing parts; the filler may be enclosed in each of the filler enclosing parts after accommodating the article 96 into the accommodating area 10*a*; or, enclosure of the filler into each of the filler enclosing parts and accommodating of the article 96 into the accommodating area 10*a* may take place at the same time (in parallel).

As described above, the cover 20 has the cover trunk (trunk 21) that includes the first cover main surface part (first main surface part 21*a*) and the second cover main surface part (second main surface part 21*b*) opposed to each other with the inner container 10 therebetween; the cover trunk (trunk 21) has the pair of cover peripheral parts (cover peripheral parts 28*a*, 28*b*), each extending from the side the opening 14 of the inner container 10 is arranged towards the opposite side, and are arranged side by side.

The filler enclosing part includes the first peripheral filler enclosing part (filler enclosing part 41) that lies along one of the pair of cover peripheral parts (cover peripheral part 28*a*), and the second peripheral filler enclosing part (filler enclosing part 42) that lies along the other one of the pair of cover peripheral parts (cover peripheral part 28*b*).

The size (distance L shown in FIG. 14(*a*)) of the inner container 10 in the direction from the first peripheral filler enclosing part (filler enclosing part 41) to the second peripheral filler enclosing part (filler enclosing part 42) in a state where the inner container 10 is collapsed and flattened, is larger than the distance d (FIG. 16(*a*)) between the first peripheral filler enclosing part (filler enclosing part 41) and the second peripheral filler enclosing part (filler enclosing part 42).

With such design, since the inner container 10 may be held by the first peripheral filler enclosing part (filler enclosing part 41) and the second peripheral filler enclosing part (filler enclosing part 42), so that the inner container 10 will more uniformly be collapsed as the volume of article 96 reduces. Hence the residence of the article 96 in the inner container 10 may be suppressed.

Here, distance d is given by the shortest distance between the first peripheral filler enclosing part and the second peripheral filler enclosing part in the direction from the first peripheral filler enclosing part (filler enclosing part 41) to the second peripheral filler enclosing part (filler enclosing part 42) (the direction the first peripheral filler enclosing part and the second peripheral filler enclosing part oppose; transverse direction in FIG. 16(*a*)).

Meanwhile, the size of the inner container 10 in the direction from the first peripheral filler enclosing part (filler enclosing part 41) to the second peripheral filler enclosing part (filler enclosing part 42) in a state where the inner container 10 is collapsed and flattened, namely distance L in FIG. 14(*a*), is the distance between the outer periphery of the cover peripheral part 28*a* and the outer periphery of the cover peripheral part 28*b*.

In more details, a part of the trunk 11 is arranged between the front filler enclosing part 41 and the rear filler enclosing part 41, and other part of the trunk 11 is arranged between the front filler enclosing part 42 and the rear filler enclosing part 42. Hence, the inner container 10 may be held stably by the filler enclosing part 41 and the filler enclosing part 42.

That is, the container 100 has the pair of first peripheral filler enclosing parts (filler enclosing parts 41) arranged to each of the first cover main surface part (first main surface part 21*a*) and the second cover main surface part (second main surface part 21*b*); and the pair of second peripheral filler enclosing parts (filler enclosing parts 42) arranged to each of the first cover main surface part (first main surface part 21*a*) and the second cover main surface part (second main surface part 21*b*); the inner container 10 has the inner container trunk (trunk 11) that includes the first inner container main surface part (first main surface part 11*a*) and the second inner container main surface part (second main surface part lib) opposed to each other with the accommodating area 10*a* for accommodating the article 96 therebetween; and a part of the inner container trunk (trunk 11) is arranged between the pair of first peripheral filler enclosing parts (filler enclosing parts 41); and the other part of the inner container trunk (trunk 11) is arranged between the pair of second peripheral filler enclosing parts (filler enclosing parts 42).

Also as described above, the cover 20 has the cover trunk (trunk 21); the cover bottom part (bottom gusset 23) that closes the end of the cover trunk, the end being on the opposite side of the opening 14 of the inner container 10; and the bottom filler enclosing part (filler enclosing part 43, filler enclosing part 45) that lies across the cover bottom part and the cover trunk; and, the inner container 10 has an inner container bottom part (bottom gusset 13) that closes the end part on the opposite side of the opening 14.

As shown in FIG. 18, the bottom gusset 13 has a folding guideline 13*a* formed therein, and, the bottom gusset 13 is bent along the folding guideline 13*a* and has a convex shape toward the inside of the inner container 10. Here, a part of the bottom gusset 13 including the folding guideline 13*a* and the part in the vicinity thereof will be referred to as "folding guide part".

That is, the inner container bottom part (bottom gusset 13) has the folding guide part, and the folding guide part is recessed towards the inside of inner container 10.

Therefore, the bottom gusset 13 will orderly be folded along the folding guideline 13*a* as the volume of the article 96 in the inner container 10 reduces, and thereby the residence of the article 96 in the inner container 10 may further be reduced.

At least a part of the bottom filler enclosing part (filler enclosing part 43 or filler enclosing part 45) is in contact with the inner container bottom part (bottom gusset 13, for example) or a part of the inner container 10 in the vicinity of the inner container bottom part (see FIG. 19).

Therefore, the inner container bottom part (bottom gusset 13) of the inner container 10 may be restricted from expanding by the bottom filler enclosing part, and thereby the folding guideline 13*a* is maintained in a bent state.

For example, as illustrated in FIG. 19, a part of the filler enclosing part 43 comes into contact with a part neighboring the inner container bottom part (bottom gusset 13) of the inner container 10.

Also a part of the filler enclosing part 45 comes into contact with a part neighboring the inner container bottom part (bottom gusset 13) of the inner container 10.

Here, the part neighboring the inner container bottom part of the inner container 10 may, for example, be the lowermost region of the trunk 11 which is equally divided into three equal regions in the height direction (vertical direction).

The cover 20 has the pair of bottom filler enclosing parts opposed to each other with an end, on the opposite side of the opening 14, of the inner container 10 therebetween.

Therefore, the inner container bottom part (bottom gusset 13) may be restricted more effectively from expanding, and thereby the folding guideline 13*a* is maintained in a bent state.

In this embodiment, the front and rear filler enclosing parts 43 are opposed to each other with the bottom gusset 13 therebetween (FIG. 19). That is, the cover trunk (trunk 21) has the first cover main surface part (first main surface part 21*a*) and the second cover main surface part (second main surface part 21*b*) opposed to each other with the inner container 10 therebetween. The cover 20 has, as the bottom filler enclosing part, the first bottom filler enclosing part (front filler enclosing part 43) that lies across the cover bottom part (bottom gusset 23) and the first cover main surface part (first main surface part 21*a*), and the second bottom filler enclosing part (rear filler enclosing part 43) that lies across the cover bottom part (bottom gusset 23) and the second cover main surface part (second main surface part 21*b*).

In addition, in this embodiment, the left and right filler enclosing parts 45 are opposed to each other with the bottom gusset 13 therebetween (FIG. 20).

As illustrated in FIG. 18, the cover bottom part (bottom gusset 23) has a bulge part 23*a* that bulges towards the inner container 10.

Therefore, the inner container bottom part (bottom gusset 13) of the inner container 10 may be restricted effectively from expanding downward, and thereby the folding guideline 13*a* is maintained in a bent state.

More specifically, the bulge part 23*a* is formed as a result of bending of the bottom gusset 23 along the folding guideline.

The cover 20 is shaped to have the cover bottom part (bottom gusset 23) that will be opposed to a placement surface, and the cover trunk (trunk 21) that includes the first cover main surface part (first main surface part 21*a*) and the second cover main surface part (second main surface part 21*b*) opposed to each other with the inner container 10 therebetween.

As illustrated in FIG. 17, a shortest distance (A) from a part that forms a boundary between the cover bottom part (bottom gusset 23) and the cover trunk (trunk 21) in the non-attached region (non-attached parts 61, 62, 63, 65, 66, 67, 68) of the cover-forming sheet member 120 to the edge of the cover-forming sheet member 120, is equal to or smaller than a half of a shortest distance (B) from a part that forms a boundary between the cover bottom part (bottom gusset 23) and the first cover main surface part (first main surface part 21*a*) to a part that forms a boundary between the cover bottom part (bottom gusset 23) and the second cover main surface part (second main surface part 21*b*) in the cover-forming sheet member 120.

Thereby, it is possible to suitably realize a structure in which the cover bottom part (bottom gusset 23) has the bulge part 23*a*.

In FIG. 17, a region of the cover-forming sheet member 120 later formed into the bottom gusset 23 is hatched.

The part that forms a boundary between the cover bottom part (bottom gusset 23) and the cover trunk (trunk 21) in the non-attached region of the cover-forming sheet member 120 represents a part in the non-attached region of the cover-forming sheet member 120, along the boundary line 161 in FIG. 17, and represents a part along the boundary line 162 in FIG. 17. The boundary line 161 represents a part along the upper one of two folding lines 71 shown in FIG. 12, meanwhile the boundary line 162 represents a part along the lower one of two folding lines 71 shown in FIG. 12.

The above-described distance A represents the shortest distance between a part of the non-attached region of the cover-forming sheet member 120 along the boundary line 161 or the boundary line 162 and the outer periphery of the cover-forming sheet member 120.

That is, the above-described distance A represents the shortest one of, the shortest distance between the left end of the boundary line 161 and the left end of the cover-forming sheet member 120 shown in FIG. 17; the shortest distance between the right end of the boundary line 161 and the right end of the cover-forming sheet member 120 shown in FIG. 17; the shortest distance between the left end of the boundary line 162 and the left end of the cover-forming sheet member 120 shown in FIG. 17; and the shortest distance between the right end of the boundary line 162 and the right end of the cover-forming sheet member 120 shown in FIG.

17. In this embodiment, all of the shortest distance between the left end of the boundary line 161 and the left end of the cover-forming sheet member 120 shown in FIG. 17, the shortest distance between the right end of the boundary line 161 and the right end of the cover-forming sheet member 120 shown in FIG. 17, the shortest distance between the left end of the boundary line 162 and the left end of the cover-forming sheet member 120 shown in FIG. 17, and, the shortest distance between the right end of the boundary line 162 and the right end of the cover-forming sheet member 120 shown in FIG. 17 are equal.

The part of the non-attached region of the cover-forming sheet member 120, which lies along the boundary line 161, represents a part that forms a boundary between the cover bottom part (bottom gusset 23) and the first cover main surface part (first main surface part 21*a*) in the cover-forming sheet member 120.

The part of the non-attached region of the cover-forming sheet member 120, which lies along the boundary line 162, represents a part that forms a boundary between the cover bottom part (bottom gusset 23) and the second cover main surface part (second main surface part 21*b*) in the cover-forming sheet member 120.

According to the first embodiment described above, the cover-forming sheet member 120 has the film region in which the plurality of film layers are attached to each other, and the filler enclosing parts 41, 42, 43, 45, 46, 47 in which the filler is enclosed between the plurality of film layers, and bulges in the thickness direction of the cover-forming sheet member 120 than the film region, and, the container 100 has an outer air introducing part 26 through which the outer air is introduced between the outer surface of the inner container 10 and the inner surface of the cover 20.

Hence, the cover 20 will have an improved rigidity due to the filler enclosing part, and will have an improved shape retention property. Since the inner container 10 is allowed for introduction of the outer air, through the outer air introducing part 26, between the outer surface of the inner container 10 and the inner surface of the cover 20, so that the inner container 10 can easily reduce its capacity independently of the cover 20 (see FIG. 16(*b*)). Hence, the article 96 in the inner container 10 may easily be discharged, while suppressing residence of the article 96 in the inner container 10.

Modified Example 1 of First Embodiment

Next, the packed article in container 300 and the container 100 according to Modified Example 1 of the first embodiment will be explained, referring to FIG. 21.

The packed article in container 300 and the container 100 of this Modified Example are different from the packed article in the container 300 and the container 100 of the first embodiment in the aspects below, but are same as the packed article in the container 300 and the container 100 of the first embodiment in other aspects.

In this Modified Example, the inner container peripheral parts 18*a* and 18*b* of the inner container 10 are not attached to the cover peripheral parts 28*a* and 28*b* of the cover 20 in the sealed part 25.

As illustrated in FIG. 21, on the sidewards of the inner container peripheral parts 18*a* and 18*b*, parts of the cover-forming sheet member 120 (parts of the first film layer 121) are attached to each other in the sealed part 27, and the cover peripheral parts 28*a* and 28*b* are formed.

In the sheet for container 200, the first non-attached region (non-attached part 61) is given in pairs, arranged to each of the first cover main surface part (first main surface part 21*a*) and the second cover main surface part (second main surface part 21*b*); the second non-attached region (non-attached part 62) is given in pairs, arranged to each of the first cover main surface part (first main surface part 21*a*) and the second cover main surface part (second main surface part 21*b*); the inner container 10 has the inner container trunk (trunk 11) that includes the first inner container main surface part (first main surface part 11*a*) and the second inner container main surface part (second main surface part 11*b*) opposed to each other with the accommodating area 10*a* for accommodating the article 96 therebetween; the inner container trunk has the pair of inner container peripheral parts 18*a*, 18*b*, each extending from the side the opening 14 is arranged towards the opposite side, and are arranged side by side; at least a part of one of the pair of inner container peripheral parts 18*a*, 18*b* is arranged between the pair of first non-attached regions (non-attached part 61), or between the pair of second non-attached regions (non-attached part 62).

In this embodiment, one (inner container peripheral part 18*a*) of the pair of inner container peripheral parts 18*a*, 18*b* is arranged between the pair of first non-attached regions (non-attached part 61), and the other one (inner container peripheral part 18*b*) of the pair of inner container peripheral parts 18*a*, 18*b* is arranged between the pair of second non-attached regions (non-attached part 62).

The inner container 10 is composed of the inner container forming sheet member 110, and at least one of the pair of inner container peripheral parts 18*a*, 18*b* is a sealed part 15 in which parts of the inner container forming sheet member 110 are attached to each other.

As illustrated in FIG. 21, at least a part of the inner container peripheral part 18*a* is arranged between the pair of front and rear filler enclosing parts 41, and at least a part of the inner container peripheral part 18*b* is arranged between the pair of front and rear filler enclosing parts 42.

That is, the container 100 has the pair of first peripheral filler enclosing parts (filler enclosing part 41) arranged to each of the first cover main surface part (first main surface part 21*a*) and the second cover main surface part (second main surface part 21*b*); and the pair of second peripheral filler enclosing parts (filler enclosing part 42) arranged to each of the first cover main surface part (first main surface part 21*a*) and the second cover main surface part (second main surface part 21*b*); the inner container 10 has the inner container trunk (trunk 11) that includes the first inner container main surface part (first main surface part 11*a*) and the second inner container main surface part (second main surface part 11*b*) opposed to each other with the accommodating area 10*a* for accommodating the article 96 therebetween; the inner container trunk (trunk 11) has the pair of inner container peripheral parts 18*a*, 18*b*, each extending from the side the opening 14 is arranged towards the opposite side and are arranged side by side; and at least a part of one of the pair of inner container peripheral parts 18*a*, 18*b* is arranged between the pair of first peripheral filler enclosing parts (filler enclosing part 41), or, between the pair of second peripheral filler enclosing parts (filler enclosing part 42). In this embodiment, at least a part of one (inner container peripheral part 18*a*) of the pair of inner container peripheral parts 18*a*, 18*b* is arranged between the pair of first peripheral filler enclosing parts (filler enclosing part 41), and at least a part of the other one (inner container peripheral part 18*b*) of the pair of inner container peripheral parts 18*a*, 18*b* is arranged between the pair of second peripheral filler enclosing parts (filler enclosing part 42).

According to this Modified Example, the inner container 10 may be held stably by the filler enclosing part 41 and the filler enclosing part 42.

Modified Example 2 of First Embodiment

Next, the packed article in container 300 and container 100 according to Modified Example 2 of the first embodiment will be explained, referring to FIG. 22(*a*).

The packed article in container 300 and the container 100 of this Modified Example are different from the packed article in the container 300 and the container 100 according to the above-described Modified Example 1 of the first embodiment (FIG. 21), in that they do not have the rear filler enclosing part 41 and the rear filler enclosing part 42, but are same as the packed article in the container 300 and the container 100 according to the Modified Example 1 of the first embodiment (FIG. 1) in other aspects.

According to this Modified Example, the inner container 10 may be held stably by the filler enclosing part 41 and the filler enclosing part 42.

Modified Example 3 of First Embodiment

Next, the packed article in container 300 and container 100 according to Modified Example 3 of the first embodiment will be explained, referring to FIG. 22(*b*).

The packed article in container 300 and the container 100 of this Modified Example are different from the packed article in the container 300 and the container 100 according to the above-described Modified Example 1 of the first embodiment (FIG. 21), in that they do not have the rear filler enclosing part 41 and front filler enclosing part 42, but are same as the packed article in the container 300 and the container 100 according to the Modified Example 1 of the first embodiment (FIG. 21) in other aspects.

According to this Modified Example, the inner container 10 may be held stably by the filler enclosing part 41 and the filler enclosing part 42.

Modified Example 4 of First Embodiment

Next, the packed article in container 300 and container 100 according to Modified Example 4 of the first embodiment will be explained, referring to FIG. 23(*a*).

The packed article in container 300 and the container 100 of this Modified Example are different from the packed article in the container 300 and the container 100 according to the above-described Modified Example 1 of the first embodiment (FIG. 21) in terms of the structure of the inner container peripheral part 18*b*, but are same as the packed article in the container 300 and the container 100 according to the Modified Example 1 of the first embodiment (FIG. 21) in other aspects.

In this Modified Example, the inner container peripheral part 18*b* is a folded part 17 in which the inner container forming sheet member 110 is folded along the folding guideline 17*a* towards the inside of the inner container 10.

According to this Modified Example, the inner container 10 may be held stably by the filler enclosing part 41 and the filler enclosing part 42.

The present invention is, however, not limited to this example, instead allowing that both of the inner container peripheral parts 18*a* and 18*b* may be the folded parts 17 in which the inner container forming sheet member 110 is folded along the folding guideline 17*a* towards the inside of the inner container 10.

As described above, the inner container 10 is composed of the inner container forming sheet member 110, and at least one of the pair of inner container peripheral parts 18*a*, 18*b* is the folded part 17 where the inner container forming sheet member 110 is folded along the folding guideline 17*a*.

Modified Example 5 of First Embodiment

Next, the packed article in container 300 and container 100 according to Modified Example 5 of the first embodiment will be explained, referring to FIG. 23(*b*).

The packed article in container 300 and the container 100 of this Modified Example are different from the packed article in the container 300 and the container 100 according to the above-described Modified Example 1 of the first embodiment (FIG. 21) in terms of the structure of the inner container peripheral part 18*b*, but are same as the packed article in the container 300 and the container 100 according to the Modified Example 1 of the first embodiment (FIG. 21) in other aspects.

In this Modified Example, the inner container peripheral part 18*b* is a turnaround part 16 at which the inner container forming sheet member 110 is folded back.

According to this Modified Example, the inner container 10 may be held stably by the filler enclosing part 41 and the filler enclosing part 42.

The present invention is, however, not limited to this example, instead allowing that both of the inner container peripheral parts 18*a* and 18*b* is the turnaround parts 16 at which the inner container forming sheet member 110 is folded back.

As described above, the inner container 10 is composed of the inner container forming sheet member 110, and at least one of the pair of inner container peripheral parts 18*a*, 18*b* is the turnaround part 16 at which the inner container forming sheet member 110 is folded back.

Modified Example 6 of First Embodiment

Next, the packed article in container 300 and container 100 according to Modified Example 6 of the first embodiment will be explained, referring to FIG. 24.

The packed article in container 300 and the container 100 of this Modified Example are different from the packed article in the container 300 and the container 100 of the first embodiment, in that the bottom gusset 23 and the bottom gusset 13 are partially attached to each other, but are same as the packed article in the container 300 and the container 100 of the first embodiment in other aspects.

In more details, in this embodiment, the bottom gusset 23 and the bottom gusset 13 are partially attached to each other at a fusion part 126 by heat sealing.

By preliminarily forming, in the second film layer 122 that composes the cover-forming sheet member 120, a through-hole 122 that extends through such second film layer 122 at a part of a portion later formed into the bottom gusset 23, it now becomes possible to partially attach a part of the first film layer 121 later formed into the bottom gusset 23 with the inner container forming sheet member 110, in heat-sealing the cover-forming sheet member 120 and the inner container forming sheet member 110 to thereby manufacture the container forming sheet 400, or, in heat-sealing the container forming sheet 400 to thereby manufacture the sheet for container 200.

As a consequence, as shown in FIG. 24, the container 100 and the packed article in container 300 having the structure in which the bottom gusset 23 and the bottom gusset 13 are partially attached to each other at the fusion part 126 are obtained.

As described above, the cover 20 in this embodiment has the cover trunk (trunk 21), and the cover bottom part (bottom gusset 23) that closes the end of the cover trunk (trunk 21), the end being on the opposite side of the opening 14 of the inner container 10; and, the cover 20 and the inner container 10 are partially attached to each other in the cover bottom part (bottom gusset 23).

Therefore, the bottom gusset 13 is suppressed from lifting up from the bottom gusset 23, making it possible to discharge the article 96 in the inner container 10 more easily.

Modified Example 7 of First Embodiment

Next, Modified Example 7 of the first embodiment will be explained, referring to FIG. 25.

The packed article in container 300 and the container 100 of this Modified Example are different from the packed article in the container 300 and the container 100 of the first embodiment in the aspects below, but are same as the packed article in the container 300 and the container 100 of the first embodiment in other aspects.

In the first embodiment described above, the inner container peripheral part 18*a* and the cover peripheral part 28*a* were attached to each other over the entire range of the inner container peripheral part 18*a*, and, the inner container peripheral part 18*b* and the cover peripheral part 28*b* were attached to each other over the entire range of the inner container peripheral part 18*b*.

In contrast, in this Modified Example, for example, the outer air introducing part 26 is formed at a position partially overlaps the inner container peripheral part 18*a*, and, the inner container peripheral part 18*a* and the cover peripheral part 28*a* are left unattached to each other at the position of formation of the outer air introducing part 26. In other words, the outer air introducing part 26 is arranged at the middle point in the direction the inner container peripheral part 18*a* extends.

Note, that the outer air introducing part 26 may be formed also at a position partially overlaps the inner container peripheral part 18*b*. That is, the outer air introducing part 26 may be arranged also at the middle point in the direction the inner container peripheral part 18*b* extends.

As described in this Modified Example, the inner container 10 has the inner container trunk (trunk 11) that includes the first inner container main surface part (first main surface part 11*a*) and the second inner container main surface part (second main surface part lib) opposed to each other with the accommodating area 10*a* for accommodating the article 96 therebetween (see FIG. 2); the inner container trunk (trunk 11) has the pair of inner container peripheral parts 18*a*, 18*b*, each extending from the side the opening 14 (FIG. 2) of the inner container 10 is arranged towards the opposite side, and are arranged side by side; and, in at least one of the pair of inner container peripheral parts 18*a*, 18*b*, the cover 20 and the inner container 10 are partially attached to each other.

Second Embodiment

Next, the packed article in container 300 and container 100 according to second embodiment will be explained, referring to FIG. 26(*a*), FIG. 26(*b*) and FIG. 27.

The packed article in container 300 and the container 100 of this embodiment are different from the packed article in the container 300 and the container 100 according to Modified Example 1 of the first embodiment (FIG. 21) in the aspects below, but are same as the packed article in the container 300 and the container 100 of Modified Example 1 of the first embodiment (FIG. 21) in other aspects.

In this embodiment, the first main surface part 21*a* and the second main surface part 21*b* are left unattached to each other, in both of the cover peripheral part 28*a* and the cover peripheral part 28*b*. In both of the cover peripheral part 28*a* and the cover peripheral part 28*b*, there are formed the outer air introducing parts 26 with a slit-like shape (FIG. 26(*a*), FIG. 26(*b*), FIG. 27) that vertically extends.

Since the first main surface part 21*a* and the second main surface part 21*b* are left unattached to each other at the cover peripheral part 28*a* and the cover peripheral part 28*b*, as illustrated in FIG. 27, the cover-forming sheet member 120 will have curved parts 125 that inwardly curls at the cover peripheral part 28*a*.

Therefore, the feeling of touching to the cover peripheral part 28*a* and the cover peripheral part 28*b* with hand becomes soft.

Note, that the slit-like outer air introducing part 26 may be formed in only one of the cover peripheral part 28*a* and the cover peripheral part 28*b*.

That is, in this embodiment, in at least one of the pair of cover peripheral parts 28*a*, 28*b*, the first cover main surface part (first main surface part 21*a*) and the second cover main surface part (second main surface part 21*b*) are left unattached to each other, and, at least one of the pair of cover peripheral parts 28*a*, 28*b* has formed therein the outer air introducing part 26 with a slit-like shape.

The container 100 of this embodiment and the packed article in container 300 may or may not have the outer air introducing part 26 at around the top gusset 22.

The filler enclosing part 41 curves, in a part thereof in the vertical direction, convexly towards the center in the width direction of the trunk 21.

Similarly, the filler enclosing part 42 curves, in a part thereof in the vertical direction, convexly towards the center in the width direction of the trunk 21.

Since the filler enclosing parts 41, 42 are thus curved, the curved parts 125 of the cover peripheral part 28*a* and cover peripheral part 28*b* are more likely to curl.

As described above, the outer air introducing part 26 is formed in at least one of the pair of cover peripheral parts 28*a*, 28*b*, and, of the filler enclosing part 41 and the filler enclosing part 42, the one (filler enclosing part 41 or filler enclosing part 42) which resides on the side of the cover peripheral part having the outer air introducing part 26 formed therein, curves convexly towards the center in the width direction of the trunk 21.

In this embodiment, the outer air introducing part 26 is formed in each of the pair of cover peripheral parts of the cover, and each of the filler enclosing part 41 and the filler enclosing part 42 curves convexly towards the center in the width direction of the trunk 21.

Third Embodiment

Next, the container 100 of the third embodiment will be explained referring to FIG. 28.

The container 100 of this embodiment is different from the above-described container 100 of the first embodiment in the aspect below. Of the constituents of the container 100 of this embodiment, constituents common to those in the above-described container 100 of the first embodiment will not be explained again.

In this embodiment, the inner container 10 is a tube container that has an end seal 152 at the end on the opposite side of the opening 14.

Along the left peripheral part (cover peripheral part 28*a*) of the cover 20, there are formed a pair of front and rear first peripheral filler enclosing parts 155. Similarly, along the right peripheral part (cover peripheral part 28*b*) of the cover 20, there are formed a pair of front and rear second peripheral filler enclosing parts 156.

The left end of the end seal 152 is arranged between the pair of front and rear first peripheral filler enclosing part 155, meanwhile the right end of the end seal 152 is arranged between the pair of front and rear second peripheral filler enclosing parts 156.

The end seal 152 may, however, be arranged only either between the pair of front and rear first peripheral filler enclosing parts 155, or between the pair of front and rear second peripheral filler enclosing parts 156.

That is, the end seal 152 is arranged at least either between the pair of first peripheral filler enclosing parts 155, or between the pair of second peripheral filler enclosing parts 156.

According to this embodiment, the inner container 10 may be held stably by the pair of first peripheral filler enclosing parts 155, or by the pair of second peripheral filler enclosing parts 156.

Fourth Embodiment

Next, the container 100 of the fourth embodiment will be explained, referring to FIG. 29 to FIG. 31.

The container 100 of this embodiment is different from the above-described container 100 of the second embodiment in the aspects below, but is same as the container 100 of the second embodiment in other aspects.

As illustrated in FIG. 29, in the case of this embodiment, the curvature of the curved shape of the filler enclosing part 41 and the filler enclosing part 42 is larger than that of the second embodiment (the radius of curvature of the curved shape of the filler enclosing part 41 and the filler enclosing part 42 is smaller than that of the second embodiment).

Hence, as illustrated in FIG. 30, the trunk 21 of the cover 20 has a shape bulging forward and backward more largely, in the curved parts of the filler enclosing part 41 and the filler enclosing part 42.

Further, as illustrated in FIG. 30, the cover 20 has a filler enclosing part 171 through which an upper end part 42*b* and a lower end part 42*c* of the curved parts of the filler enclosing part 42 communicate with each other.

The filler enclosing part 171 is arranged between the curved part of the filler enclosing part 42 and the cover peripheral part 28*b*.

In the case of this embodiment, the filler enclosing part 171 extends linearly in the vertical direction. The filler enclosing part 171 may, however, curve convexly towards the cover peripheral part 28*b* side.

Similarly, the cover 20 has the filler enclosing part 171 through which an upper end part and a lower end part of the curved part of the filler enclosing part 41 communicate with each other.

The filler enclosing part 171 is, for example, thinner than the filler enclosing part 41 and the filler enclosing part 42. That is, for example, the cross-sectional area of the filler enclosing part 171 in a cross section normal to the extending direction of the filler enclosing part 171 is smaller than the cross-sectional area of the filler enclosing part 41 in a cross section normal to the extending direction of the filler enclosing part 41, and, is smaller than the cross-sectional area of the filler enclosing part 42 in a cross section normal to the extending direction of the filler enclosing part 42.

In the container 100 of such structure, the side face of the cover 20 (in particular, a region that ranges over the height of filler enclosing part 171) is made flat, the peripheral edge part of the outer air introducing part 26 is positionally stabilized in the cover 20 (in the cover-forming sheet member 120), and thereby the cover 20 will have an improved appearance and holdability.

The left and right side faces of the cover 20 are opposed to each other.

The cover-forming sheet member 120 employable in this embodiment may have a structure illustrated in FIG. 31.

The cover-forming sheet member 120 has a non-attached part 172. The non-attached part 172 is arranged along a part to be the curved part of the filler enclosing part 41 in the non-attached part 61.

Note that although the container 100 illustrated in FIG. 29 to FIG. 31 does not have the filler enclosing part 46 and the non-attached part 66, the container 100 in this embodiment may alternatively have the filler enclosing part 46 and the non-attached part 66.

The present invention is not limited to the above-described embodiments and the individual Modified Examples, and allows various modifications and improvements, so far as the object of the present invention is achieved.

For example, although the description above dealt with the case where the pumping cap 90 is attached to the cylinder part 32 of the spout 30, a simple screw cap, dispenser or the like (for example, trigger dispenser) may be attached to the cylinder part 32 of the spout 30.

In the above description, the filler introducing part 29 including the non-attached part 68 is cut off in the state of the container 100, but the container 100 may alternatively have the filler introducing part 29 remained thereon in the state that the non-attached part 68 is filled with the filler. In this case, when the container 100 is discarded, the filler introducing part 29 may be broken to allow the inside of the non-attached part 68 to communicate with the outer air, and the filler (air, for example) in each of the filler enclosing parts 41 to 47 may be discharged through the non-attached part 68 to the outside, allowing the container 100 to be flattened and thinned.

In the above description, in the gap 49 (FIG. 6(*b*)) at the bottom part of the cover 20, the bottom gusset peripheral sealed part 15*a* at the bottom part of the inner container 10 is sandwiched between the filler enclosing part 43 and the filler enclosing part 45. In addition to this configuration, the sealed part 15 of the bottom gusset 13 of the inner container 10 may be attached to the bottom part of the cover 20.

For example, in the state of the container forming sheet 400 illustrated in FIG. 11 and FIG. 12, the inner container forming sheet member 110 and the cover-forming sheet member 120 have the same shape, the inner container forming sheet member 110 and the cover-forming sheet member 120 are stacked so as to align the outer contour of the inner container forming sheet member 110 and the outer contour of the cover-forming sheet member 120, and the peripheral part of the inner container forming sheet member 110 and the peripheral part of the cover-forming sheet member 120 are attached to each other.

In this case, the inner container forming sheet member 110 and the cover-forming sheet member 120 may be punched out using a common cutting edge, and this facilitates the manufacturing process of the container 100.

In the above description, the inner container 10 has the top gusset 12, as well as the cover 20 has the top gusset 22, the inner container 10 and the cover 20 may not have the top gusset 12 and top gusset 22.

The embodiments encompass the technical spirits below.

<1> A container that includes:

an inner container that accommodates an article, with an opening through which the article can be discharged; and a cover that is composed of a cover-forming sheet member given by lamination of a plurality of film layers, and covers the inner container, the cover-forming sheet member has a film region in which the plurality of film layers are attached to each other, and a filler enclosing part in which a filler is enclosed between the plurality of film layers, and bulges in the thickness direction of the cover-forming sheet member than the film region, and, the container comprising an outer air introducing part through which the outer air is introduced between the outer surface of the inner container and the inner surface of the cover.

<2> The container according to <1>, wherein the cover and the inner container are partially attached to each other.

<3> The container according to <2>, wherein the cover and the inner container are attached to each other at around the opening of the inner container.

<4> The container according to <2> or <3>, wherein the cover has a cover trunk that includes a first cover main surface part and a second cover main surface part opposed to each other with the inner container therebetween, the cover trunk has a pair of cover peripheral parts, each extending from the side the opening of the inner container is arranged towards the opposite side, and are arranged side by side, and, in at least one of the pair of cover peripheral parts, the cover and the inner container are partially attached to each other.

<5> The container according to any one of <2> to <4>, wherein the cover includes:

a cover trunk; and a cover bottom part that closes the end of the cover trunk, the end being on the opposite side of the opening of the inner container, and, the cover and the inner container are partially attached to each other in the cover bottom part.

<6> The container according to any one of <1> to <5>, wherein the cover has a cover trunk that includes a first cover main surface part and a second cover main surface part opposed to each other with the inner container therebetween, the cover trunk has a pair of cover peripheral parts, each extending from the side the opening of the inner container is arranged towards the opposite side, and are arranged side by side, the filler enclosing part includes a first peripheral filler enclosing part that lies along one of the pair of cover peripheral parts, and a second peripheral filler enclosing part that lies along the other one of the pair of cover peripheral parts, and, a size of the inner container in the direction from the first peripheral filler enclosing part to the second peripheral filler enclosing part in a state where the inner container is collapsed and flattened, is larger than the distance between the first peripheral filler enclosing part and the second peripheral filler enclosing part.

<7> The container according to <6>, wherein the first peripheral filler enclosing part is given in pairs, arranged to each of the first cover main surface part and the second cover main surface part, and the second peripheral filler enclosing part is given in pairs, arranged to each of the first cover main surface part and the second cover main surface part, the inner container has an inner container trunk that includes a first inner container main surface part and a second inner container main surface part opposed to each other with the accommodating area for accommodating the article therebetween, the inner container trunk has a pair of inner container peripheral parts, each extending from the side the opening is arranged towards the opposite side, and are arranged side by side, and, at least a part of one of the pair of inner container peripheral parts is arranged between the pair of first peripheral filler enclosing parts, or, between the pair of second peripheral filler enclosing parts.

<8> The container according to <7>, wherein the inner container is composed of an inner container forming sheet member, and at least one of the pair of inner container peripheral parts is a sealed region in which parts of the inner container forming sheet member are attached to each other.

<9> The container according to <7> or <8>, wherein the inner container is composed of an inner container forming sheet member, and at least one of the pair of inner container peripheral parts is a folded part where the inner container forming sheet member is folded along a folding guideline.

<10> The container according to <7>, wherein the inner container is a tube container that has an end seal at the end on the opposite side of the opening, and the end seal is arranged at least either between the pair of first peripheral filler enclosing parts, or between the pair of second peripheral filler enclosing parts.

<11> The container according to any one of <6> to <10>, wherein the first peripheral filler enclosing part is given in pairs, arranged to each of the first cover main surface part and the second cover main surface part, and the second peripheral filler enclosing part is given in pairs, arranged to each of the first cover main surface part and the second cover main surface part, the outer air introducing part is formed in at least one of the pair of cover peripheral parts, and, of the first peripheral filler enclosing part and the second peripheral filler enclosing part, the one which resides on the side of the cover peripheral part having the outer air introducing part formed therein, curves convexly towards the center in the width direction of the cover trunk.

<12> The container according to any one of <1> to <11>, wherein the cover includes:

a cover trunk;

a cover bottom part that closes the end of the cover trunk, the end being on the opposite side of the opening of the inner container; and a bottom filler enclosing part that lies across the cover bottom part and the cover trunk, the inner container has an inner container bottom part that closes the end part on the opposite side of the opening, and, the inner container bottom part has a folding guide part, and the folding guide part is recessed towards the inside of the inner container.

<13> The container according to <12>, wherein at least a part of the bottom filler enclosing part is in contact with the inner container bottom part or a part of the inner container in the vicinity of the inner container bottom part.

<14> The container according to <12> or <13>, wherein the bottom filler enclosing part is given in pairs, opposed to each other with an end part of the inner container opposite to the opening therebetween.

<15> The container according to any one of <12> to <14>, wherein the cover bottom part has a bulge part that bulges toward the inner container.

<16> A packed article in container, which includes:

the container described in any one of <1> to <15>; and, an article, accommodated in the inner container.

<17> A sheet for container which includes:

an inner container that accommodates an article, with an opening through which the article can be discharged; and a cover that is composed of a cover-forming sheet member given by lamination of a plurality of film layers, and covers the inner container, the cover-forming sheet member has a film region in which the plurality of film layers are attached to each other, and a non-attached region in which the plurality of film layers are left partially unattached to each other, and, the sheet for container comprising an outer air introducing part through which the outer air is introduced between the outer surface of the inner container and the inner surface of the cover.

<18> A container forming sheet which includes:

an inner container forming sheet member that forms an inner container after being folded and attached to each other at the peripheral parts thereof;

a cover-forming sheet member given by lamination of a plurality of film layers, on which the inner container forming sheet member is stacked, and forms a cover that covers the inner container; and a peripheral attached part in which a peripheral part of the cover-forming sheet member and a peripheral part of the inner container forming sheet member are attached to each other, the cover-forming sheet member comprising a film region in which the plurality of film layers are attached to each other, and a non-attached region in which the plurality of film layers are left partially unattached to each other, the container forming sheet having, in an inner region surrounded by the peripheral attached part, a second non-attached region in which the cover-forming sheet member and the inner container forming sheet member are left unattached to each other, the container forming sheet having a third non-attached region in which the cover-forming sheet member and the inner container forming sheet member are left unattached to each other partially in the direction the peripheral attached part extends, and, a gap formed between the cover-forming sheet member and the inner container forming sheet member in the second non-attached region is communicating with a space outside the container forming sheet through the third non-attached region.

<19> A container forming sheet according to <18>, wherein the cover is shaped to have a cover bottom part that will be opposed to a placement surface, and a cover trunk that includes a first cover main surface part and a second cover main surface part opposed to each other with the inner container therebetween, and, a shortest distance (A) from a part that forms a boundary between the cover bottom part and the cover trunk in the non-attached region of the cover-forming sheet member to the edge of the cover-forming sheet member, is equal to or smaller than a half of a shortest distance (B) from a part that forms a boundary between the cover bottom part and the first cover main surface part to a part that forms a boundary between the cover bottom part and the second cover main surface part in the cover-forming sheet member.

<20> A method for manufacturing a container, which includes:

preparing an inner container forming sheet member for composing an inner container;

preparing a cover-forming sheet member for composing a cover, given by lamination of a plurality of film layers, and includes a film region in which the plurality of film layers are attached to each other, and a non-attached region in which the plurality of film layers are left partially unattached to each other;

arranging the cover-forming sheet member and the inner container forming sheet member in a stacked manner;

folding the cover-forming sheet member and the inner container forming sheet member, and attaching peripheral parts of the inner container forming sheet member to each other, to form the inner container, and make the cover composed of the cover-forming sheet member covers the inner container, and an outer air introducing part through which the outer air can be introduced between the outer surface of the inner container and the inner surface of the cover is formed between the cover and the inner container or formed in the cover; and enclosing a filler into the non-attached region.

<21> The container according to any one of the preceding items, wherein the first peripheral filler enclosing part is given in pairs, arranged to each of the first cover main surface part and the second cover main surface part, and the second peripheral filler enclosing part is given in pairs, arranged to each of the first cover main surface part and the second cover main surface part, the inner container has an inner container trunk that includes a first inner container main surface part and a second inner container main surface part opposed to each other with the accommodating area for accommodating the article therebetween, a part of the inner container trunk is arranged between the pair of first peripheral filler enclosing parts, and other part of the inner container trunk is arranged between the pair of second peripheral filler enclosing parts.

<22> The container according to any one of the preceding items, wherein the cover has a cover trunk that includes a first cover main surface part and a second cover main surface part opposed to each other with the inner container therebetween, the cover trunk has a pair of cover peripheral parts, each extending from the side the opening of the inner container is arranged towards the opposite side, and are arranged side by side, in at least one of the pair of cover peripheral parts, the first cover main surface part and the second cover main surface part are left unattached to each other, and at least one of the pair of cover peripheral parts has formed therein the outer air introducing part with a slit-like shape.

<23> The container according to any one of the preceding items, wherein the inner container is composed of an inner container forming sheet member, and at least one of the pair of inner container peripheral parts is a turnaround part at which the inner container forming sheet member is folded back.

<24> The container according to any one of the preceding items, wherein the inner container has an inner container trunk that includes a first inner container main surface part and a second inner container main surface part opposed to each other with the accommodating area for accommodating the article therebetween, the inner container trunk has a pair of inner container peripheral parts, each extending from the side the opening is arranged towards the opposite side, and are arranged side by side, and, in at least one of the pair of inner container peripheral parts, the cover and the inner container are partially attached to each other.

<25> The sheet for container according to any one of the preceding items, wherein the cover has a cover trunk that includes a first cover main surface part and a second cover main surface part opposed to each other with the inner container therebetween, the cover trunk has a pair of cover peripheral parts, each extending from the side the opening of the inner container is arranged towards the opposite side, and are arranged side by side, the non-attached region includes a first non-attached region (non-attached part 61) that extends along one of the pair of cover peripheral parts, and a second non-attached region (non-attached part 62) that extends along the other one of the pair of cover peripheral parts, and, a size of the inner container in the direction from the first non-attached region to the second non-attached region, is larger than the distance between the first non-attached region and the second non-attached region.

<26> A sheet for container according to <23>, wherein the first non-attached region is given in pairs, arranged to each of the first cover main surface part and the second cover main surface part, and the second non-attached region is given in pairs, arranged to each of the first cover main surface part and the second cover main surface part, the inner container has an inner container trunk that includes a first inner container main surface part and a second inner container main surface part opposed to each other with the accommodating area for accommodating the article therebetween, the inner container trunk has a pair of inner container peripheral parts, each extending from the side the opening is arranged towards the opposite side, and are arranged side by side, one of the pair of inner container peripheral parts is arranged between the pair of first non-attached region, and, the other one of the pair of inner container peripheral parts is arranged between the pair of second non-attached region.

<27> The sheet for container according to <26>, wherein the inner container is composed of an inner container forming sheet member, and at least one of the pair of inner container peripheral parts is a sealed part in which parts of the inner container forming sheet member are attached to each other.

EXPLANATION OF REFERENCE CHARACTERS

10 inner container
10*a* accommodating area
11 trunk (inner container trunk)
11*a* first main surface part (first inner container main surface part)
11*b* second main surface part (second inner container main surface part)
12 top gusset
13 bottom gusset (inner container bottom part)
13*a* folding guideline
14 opening
15 sealed part
15*a* bottom gusset peripheral sealed part
16 turnaround part
17 folded part
17*a* folding guideline
18*a* inner container peripheral part
18*b* inner container peripheral part
20 cover
21 trunk (cover trunk)
21*a* first main surface part (first cover main surface part)
21*b* second main surface part (second cover main surface part)
22 top gusset
23 bottom gusset (cover bottom part)
23*a* bulge
24 opening
25 sealed part
26 outer air introducing part
27 sealed part
28*a* cover peripheral part
28*b* cover peripheral part
29 filler introducing part
30 spout
31 base
32 cylinder part
41 filler enclosing part
41*a* lower part
42 filler enclosing part
42*a* lower part
42*b* upper end part
42*c* lower end part
43 filler enclosing part
45 filler enclosing part
46 filler enclosing part
47 filler enclosing part
49 gap
51 first main surface sheet part
52 second main surface sheet part
53 first bottom gusset sheet part
54 second bottom gusset sheet part
55 top gusset sheet part
56 top gusset attaching part
57 top gusset attaching part
58 notched part
61 non-attached part
62 non-attached part
63 non-attached part
65 non-attached part
66 non-attached part

67 non-attached part
68 non-attached part
71 folding line
72 folding line
73 folding line
74 folding line
90 pumping cap
91 cap
92 upright cylinder
93 depressable part
94 nozzle
95 liquid feeding tube
96 article
100 container
110 inner container forming sheet member
111 inner surface
112 outer surface
117*a* inlet forming part
120 cover-forming sheet member
121 first film layer
122 second film layer
123 non-attaching part
124 third non-attached region
125 curved part
126 fusion part
131 first layer
132 second layer
133 third layer
141 first layer
142 second layer
143 third layer
143 fourth layer
151 gusset
152 end seal
155 first peripheral filler enclosing part
156 second peripheral filler enclosing part
161, 162 boundary line
171 filler enclosing part
172 non-attached part
200 sheet for container
300 packed article in container
400 container forming sheet

The invention claimed is:

1. A container comprising:

an inner container that accommodates an article including an opening through which the article can be discharged; and a cover that is composed of a cover-forming sheet member including a plurality of film layers, and that covers the inner container, wherein the cover-forming sheet member has:

a film region in which the plurality of film layers are attached to each other, and a filler enclosing part in which a filler is enclosed between the plurality of film layers, the filler enclosing part bulges in a thickness direction of the cover-forming sheet member in comparison to the film region, the cover has a cover trunk that includes a first cover main surface part and a second cover main surface part opposed to each other with the inner container therebetween, the cover trunk has a pair of cover peripheral parts, each extending from a side of the inner container including the opening towards an opposite side of the inner container, the pair of cover peripheral parts are arranged side by side, and in at least one cover peripheral part of the pair of cover peripheral parts, the cover and the inner container are partially attached to each other.

2. The container according to claim 1, wherein the cover and the inner container are attached to each other at around the opening of the inner container.

3. The container according to claim 1, wherein the cover comprises:

a cover bottom part that closes an end of the cover trunk, the end being on an opposite side of the inner container from a side of the inner container including the opening, and the cover and the inner container are partially attached to each other in the cover bottom part.

4. The container according to claim 1, wherein the filler enclosing part includes:

a first peripheral filler enclosing part that lies along one of the pair of cover peripheral parts, and a second peripheral filler enclosing part that lies along the other of the pair of cover peripheral parts, and a size of the inner container in a direction from the first peripheral filler enclosing part to the second peripheral filler enclosing part in a state where the inner container is collapsed and flattened is larger than a distance between the first peripheral filler enclosing part and the second peripheral filler enclosing part.

5. The container according to claim 4, wherein the first peripheral filler enclosing part includes a pair of first peripheral filler enclosing parts, one of the pair of first peripheral filler enclosing parts arranged to the first cover main surface part and the other of the pair of first peripheral filler enclosing parts arranged to the second cover main surface part, the second peripheral filler enclosing part includes a pair of second peripheral filler enclosing parts, one of the pair of second peripheral filler enclosing parts arranged to the first cover main surface part and the other of the pair of second peripheral filler enclosing parts arranged to the second cover main surface part, the inner container has an inner container trunk that includes a first inner container main surface part and a second inner container main surface part opposed to each other with an accommodating area for accommodating the article therebetween, the inner container trunk has a pair of inner container peripheral parts, each extending from the side towards the opposite side, the pair of inner container peripheral parts are arranged side by side, and at least a part of one of the pair of inner container peripheral parts is arranged between the pair of first peripheral filler enclosing parts or between the pair of second peripheral filler enclosing parts.

6. The container according to claim 5, wherein the inner container is composed of an inner container forming sheet member, and at least one inner container peripheral part of the pair of inner container peripheral parts is a sealed part in which parts of the inner container forming sheet member are attached to each other.

7. The container according to claim 5, wherein the inner container is composed of an inner container forming sheet member, and at least one inner container peripheral part of the pair of inner container peripheral parts is a folded part where the inner container forming sheet member is folded along a folding guideline.

8. The container according to claim 5, wherein the inner container is a tube container that has an end seal at the opposite side, and the end seal is arranged at least either between the pair of first peripheral filler enclosing parts or between the pair of second peripheral filler enclosing parts.

9. The container according to claim 4, further comprising an outer air introducing part through which outer air is introduced between an outer surface of the inner container and an inner surface of the cover, wherein the first peripheral filler enclosing part includes a pair of first peripheral filler enclosing parts, one of the pair of first peripheral filler enclosing parts arranged to the first cover main surface part and the other of the pair of first peripheral filler enclosing parts arranged to the second cover main surface part, the second peripheral filler enclosing part includes a pair of second peripheral filler enclosing parts, one of the pair of second peripheral filler enclosing parts arranged to the first cover main surface part and the other of the pair of second peripheral filler enclosing parts arranged to the second cover main surface part, the outer air introducing part is formed in at least one cover peripheral part of the pair of cover peripheral parts, and of the first peripheral filler enclosing part and the second peripheral filler enclosing part, the one which resides on a side of the at least one cover peripheral part having the outer air introducing part formed therein, curves convexly towards a center in a width direction of the cover trunk.

10. The container according to claim 1, wherein the cover comprises:

a cover bottom part that closes an end of the cover trunk, the end being on an opposite side of the inner container from a side of the inner container including the opening; and a bottom filler enclosing part that lies across the cover bottom part and the cover trunk, the inner container has an inner container bottom part that closes an end part of the inner container on the opposite side, the inner container bottom part has a folding guide part, and the folding guide part is recessed towards the inside of the inner container.

11. The container according to claim 10, wherein at least a part of the bottom filler enclosing part is in contact with the inner container bottom part or a part of the inner container in a vicinity of the inner container bottom part.

12. The container according to claim 10, wherein the bottom filler enclosing part includes a pair of bottom filler enclosing parts opposed to each other with an end part of the inner container opposite to the opening therebetween.

13. The container according to claim 10, wherein the cover bottom part has a bulge part that bulges toward the inner container.

14. An apparatus, comprising:

the container described in claim 1; and the article, accommodated in the inner container.

15. A sheet for a container comprising:

an inner container that accommodates an article, with an opening through which the article can be discharged; and a cover that is composed of a cover-forming sheet member including a plurality of film layers, and covers the inner container, wherein the cover-forming sheet member has:

a film region in which the plurality of film layers are attached to each other, and a region in which the plurality of film layers are left partially unattached to each other, the cover has a cover trunk that includes a first cover main surface part and a second cover main surface part opposed to each other with the inner container therebetween, the cover trunk has a pair of cover peripheral parts, each extending from a side of the inner container including the opening towards an opposite side of the inner container, the pair of cover peripheral parts are arranged side by side, and in at least one cover peripheral part of the pair of cover peripheral parts, the cover and the inner container are partially attached to each other.

16. A container forming sheet comprising:

an inner container forming sheet member that forms an inner container with an opening after being folded and attached at peripheral parts thereof;

a cover-forming sheet member including a plurality of film layers, on which the inner container forming sheet member is stacked, that forms a cover that covers the inner container; and a peripheral attached part in which a peripheral part of the cover-forming sheet member and a peripheral part of the inner container forming sheet member are attached to each other, wherein the cover-forming sheet member comprises:

a film region in which the plurality of film layers are attached to each other, and a first region in which the plurality of film layers are left partially unattached to each other, the container forming sheet has, in an inner region surrounded by the peripheral attached part, a second region in which the cover-forming sheet member and the inner container forming sheet member are left unattached to each other, the cover has a cover trunk that includes a first cover main surface part and a second cover main surface part opposed to each other with the inner container therebetween, the cover trunk has a pair of cover peripheral parts, each extending from a side of the inner container including the opening towards an opposite side of the inner container, the pair of cover peripheral parts are arranged side by side, and in at least one cover peripheral part of the pair of cover peripheral parts, the cover and the inner container are partially attached to each other.

17. The container forming sheet according to claim 16, wherein the cover is shaped to have a cover bottom part that will be opposed to a placement surface, and a shortest distance from a part that forms a boundary between the cover bottom part and the cover trunk in the first region of the cover-forming sheet member to an edge of the cover-forming sheet member is equal to or smaller than a half of a shortest distance from a part that forms a boundary between the cover bottom part and the first cover main surface part to a part that forms a boundary between the cover bottom part and the second cover main surface part in the cover-forming sheet member.

18. The container according to claim 1, further comprising an outer air introducing part through which outer air is introduced between an outer surface of the inner container and an inner surface of the cover.

* * * * *